US008843030B2

(12) United States Patent
Ishikake

(10) Patent No.: US 8,843,030 B2
(45) Date of Patent: Sep. 23, 2014

(54) WASTE TONER COLLECTION UNIT FOR AN IMAGE FORMING APPARATUS

(75) Inventor: Satoru Ishikake, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 722 days.

(21) Appl. No.: 12/926,290

(22) Filed: Nov. 8, 2010

(65) Prior Publication Data

US 2011/0110694 A1 May 12, 2011

(30) Foreign Application Priority Data

Nov. 12, 2009 (JP) ..... 2009-258811

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01)
USPC ..... 399/120; 399/358; 399/360

(58) Field of Classification Search
USPC ..... 399/120, 358, 360
See application file for complete search history.

(56) References Cited

U.S. PATENT DOCUMENTS

| | | | | |
|---|---|---|---|---|
| 7,606,523 | B2 * | 10/2009 | Kubo | 399/360 |
| 8,000,636 | B2 * | 8/2011 | Sano | 399/120 |
| 2010/0239341 | A1 * | 9/2010 | Tanaka et al. | 399/360 |

FOREIGN PATENT DOCUMENTS

| | | | | |
|---|---|---|---|---|
| JP | 10-319805 | | 12/1998 | |
| JP | 2001209286 | A * | 8/2001 | G03G 21/10 |
| JP | 3550990 | | 5/2004 | |
| JP | 2006-154411 | | 6/2006 | |
| JP | 2009-003384 | | 1/2009 | |

OTHER PUBLICATIONS

Machine Translation of JP 2001-209286 provided for applicant's convenience.*
Abstract of JP 11-167327 published Jun. 22, 1999.

* cited by examiner

*Primary Examiner* — David Gray
*Assistant Examiner* — Laura Roth
(74) *Attorney, Agent, or Firm* — Harness, Dickey & Pierce, P.L.C.

(57) ABSTRACT

An image forming apparatus using electrophotography includes a waste toner container and an accommodation unit. The waste toner container collects developer used for forming images and ejected from an image forming unit of the image forming apparatus as waste toner. The accommodation unit detachably accommodates the waste toner container in the image forming apparatus. The accommodation unit includes a reduction device to reduce a force required for withdrawing the waste toner container from an interior to an exterior of the image forming apparatus. The reduction device contacts a bottom face of the waste toner container when the waste toner container is partially withdrawn from a fully mounted position of the waste toner container in the accommodation unit to the exterior of the image forming apparatus.

18 Claims, 12 Drawing Sheets

WASTE TONER COLLECTION UNIT FOR AN IMAGE FORMING APPARATUS

CROSS-REFERENCE TO RELATED APPLICATIONS

This application claims priority to Japanese Patent Application No. 2009-258811, filed on Nov. 12, 2009 in the Japan Patent Office, which is hereby incorporated by reference herein in its entirety.

BACKGROUND OF THE INVENTION

1. Field of the Invention

The present invention relates to an image forming apparatus having a waste toner container, such as a copier, facsimile machine, printer, or the like.

2. Description of the Background Art

Generally, image forming apparatuses have a waste toner container, which collects waste toner ejected from image forming units when image forming operations are conducted. When the waste toner container becomes full or nearly full of waste toner, the waste toner container is removed from the apparatus and replaced.

With the spread of high-speed printing operations recently, the amount of waste toner generated has increased substantially and replacement of the waste toner container is carried out more frequently than ever. Replacement frequency can be reduced by employing waste toner containers of greater size, but doing so means an increase in weight of the waste toner containers when full, requiring operators to exert greater force to replace the waste toner container.

In light of the above-described situation, JP-H10-319805-A discloses a configuration in which a plurality of rollers are attached to the bottom of the waste toner container, so that the waste toner container can be easily mounted in a storage chamber of the container, or removed from the storage chamber.

However, with the configuration described in JP-H10-319805-A, because the rollers are attached to the bottom of the waste toner container, the waste toner container mounted in the apparatus may exit the apparatus if the apparatus is vibrated and the rollers begin to rotate.

SUMMARY

In one aspect of the present invention, an image forming apparatus using electrophotography including a waste toner container and an accommodation unit is devised. The waste toner container collects developer used for forming images and ejected from an image forming unit of the image forming apparatus as waste toner. The accommodation unit detachably accommodates the waste toner container in the image forming apparatus. The accommodation unit includes a reduction device to reduce a force required for withdrawing the waste toner container from an interior to an exterior of the image forming apparatus. The reduction device contacts a bottom face of the waste toner container when the waste toner container is partially withdrawn from a fully mounted position of the waste toner container in the accommodation unit to the exterior of the image forming apparatus.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
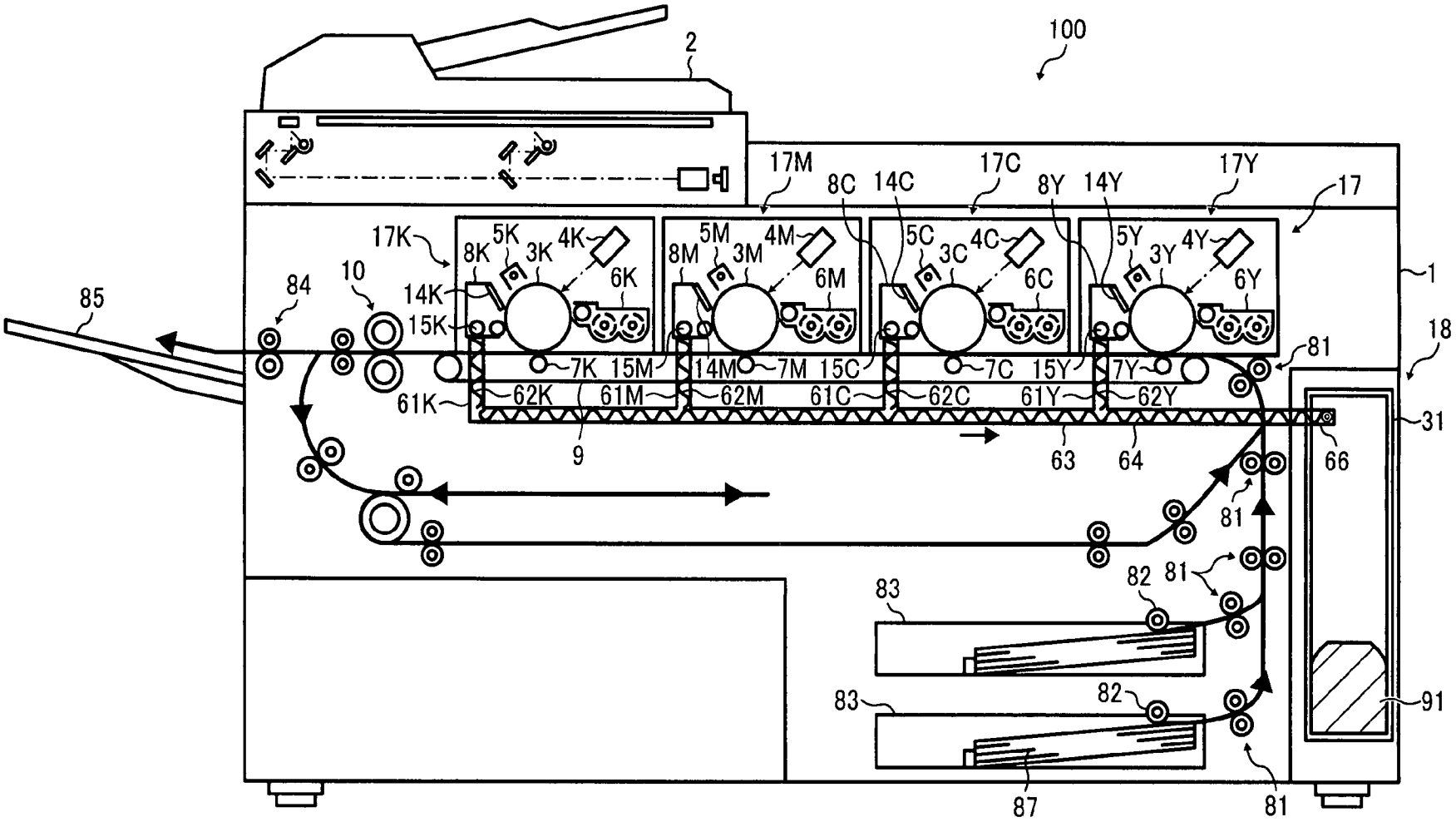
FIG. 1 shows an image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner. Referring now to the drawings, an image forming apparatus according to example embodiments are described hereinafter.

FIG. 1 shows a schematic configuration of an image forming apparatus 100 according to example embodiment. The image forming apparatus 100 shown in FIG. 1 may form color image using four color toner such as for example yellow (Y), cyan (C), magenta (M), and black (K). The image forming apparatus 100 has a front side and a rear side for an apparatus body of image forming apparatus 100. Hereinafter, the apparatus body of image forming apparatus 100 may be simply referred to as apparatus 1. The image forming apparatus 100 may include an image scanner 2, image forming units 17Y, 17C, 17M, and 17K, and a transfer belt 9, for example. The image scanner 2 scans image data from document, and then the image forming units 17Y, 17C, 17M, and 17K form each color image based on the image data scanned by the image scanner 2 and transfer each color image onto the transfer belt 9.

Each of the image forming units 17Y, 17C, 17M, and 17K is disposed along the transfer belt 9. Each of the image forming units 17Y, 17C, 17M, and 17K, respectively includes photoconductors 3Y, 3C, 3M, and 3K, exposing devices 4Y, 4C, 4M, and 4K, charging devices 5Y, 5C, 5M, and 5K, development devices 6Y, 6C, 6M, and 6K, transfer rollers 7Y, 7C, 7M, and 7K, and cleaning devices 8Y, 8C, 8M, and 8K.

Each of the photoconductors 3Y, 3C, 3M, and 3K is, respectively, surrounded with the exposing devices 4Y, 4C, 4M, and 4K, the charging devices 5Y, 5C, 5M, and 5K, the development devices 6Y, 6C, 6M, and 6K, the transfer rollers 7Y, 7C, 7M, and 7K, the cleaning devices 8Y, 8C, 8M, and 8K.

Each of the charging devices 5Y, 5C, 5M, and 5K charges the surface of the corresponding photoconductors 3Y, 3C, 3M, and 3K. Each of the exposing devices 4Y, 4C, 4M, and 4K irradiates laser beam to the corresponding photoconductors 3Y, 3C, 3M, and 3K to form electrostatic latent images on the surface of each of the photoconductors 3Y, 3C, 3M, and 3K. Each of the development devices 6Y, 6C, 6M, and 6K develops electrostatic latent images formed on the surface of corresponding photoconductors 3Y, 3C, 3M, and 3K using each color toner to form toner image on the surface of each of the photoconductors 3Y, 3C, 3M, and 3K.

Each of the cleaning devices 8Y, 8C, 8M, and 8K wipes waste toner 91 remaining on the corresponding photoconductors 3Y, 3C, 3M, and 3K to clean the photoconductors 3Y, 3C, 3M, and 3K.

Each of the transfer rollers 7Y, 7C, 7M, and 7K, disposed inside of the transfer belt 9, faces the corresponding photoconductors 3Y, 3C, 3M, and 3K via the transfer belt 9. Each of the transfer rollers 7Y, 7C, 7M, and 7K is used to transfer toner images from the corresponding photoconductors 3Y, 3C, 3M, and 3K to a transfer sheet 87, transported on the transfer belt 9 along the photoconductors 3Y, 3C, 3M, and 3K.

Further, the image forming apparatus 100 includes a sheet feed tray 83, a sheet feed roller 82, and a transport roller 81 under the transfer belt 9. The sheet feed tray 83 stores the transfer sheet 87 as recording media. The sheet feed roller 82 feeds sheets stacked in the sheet feed tray 83 from the top sheet one by one as the transfer sheet 87 to the transport roller 81. The transport roller 81 transports the transfer sheet 87 fed from the sheet feed roller 82 to upward such as to the transfer belt 9.

Further, the image forming apparatus 100 includes the fusing roller 10, and a sheet ejection roller 84 at a downstream of transfer sheet transport direction by the transfer belt 9. The fusing roller 10 is used to fix toner image on the transfer sheet 87, and the sheet ejection roller 84 ejects the transfer sheet 87 having fused with image to a sheet ejection tray 85.

The cleaning device 8 may include a cleaning blade 14 and a cleaning device screw 15. The cleaning blade 14, adapted to contact the photoconductor 3, removes the waste toner 91, which is not transferred to transfer sheet, form the surface of the photoconductor 3, and the cleaning device screw 15 transports the waste toner 91 removed by the cleaning blade 14 from the cleaning device 8 to an outside of the cleaning device 8.

Further, the image forming apparatus 100 includes a waste toner container 31 and an accommodation unit 18 at a location such as for example next to a sheet transport route extending from the sheet feed tray 83, the sheet feed roller 82, the transport roller 81, and the transfer belt 9. The waste toner container 31 collects or accumulates the waste toner 91, and the accommodation unit 18 detachably accommodates the waste toner container 31 therein, which means the waste toner container 31 can be attached in the accommodation unit 18 and detached from the accommodation unit 18, as required.

A description is given to image forming operation of the image forming apparatus 100. First, each of the charging devices 5Y, 5C, 5M, and 5K uniformly charges the corresponding photoconductors 3Y, 3C, 3M, and 3K. Then, each of the exposing devices 4Y, 4C, 4M, and 4K irradiates a laser beam, generated based on image data scanned by the image scanner 2, to the corresponding photoconductors 3Y, 3C, 3M, and 3K (exposing scan process) to form an electrostatic latent image on each of the photoconductors 3Y, 3C, 3M, and 3K. Each of the development devices 6Y, 6C, 6M, and 6K develops the electrostatic latent image formed on each of the photoconductors 3Y, 3C, 3M, and 3K using corresponding toner to form yellow, cyan, magenta, and black toner image on each of the photoconductors 3Y, 3C, 3M, and 3K.

On one hand, the transfer sheet 87, fed from the sheet feed tray 83 by the sheet feed roller 82, is transported to a nip portion, defined by the photoconductor 3Y and the transfer roller 7Y, using the transport roller 81.

Each of the transfer rollers 7Y, 7C, 7M, and 7K transfers a toner image formed on the corresponding photoconductors 3Y, 3C, 3M, and 3K onto the transfer sheet 87 to form an image on the transfer sheet 87. The transfer sheet 87 transferred with the toner images is transported to the fusing roller 10 to fuse the transferred image on the fusing roller 10, and then ejected to the sheet ejection tray 85 by the sheet ejection roller 84.

Each of the cleaning devices 8Y, 8C, 8M, and 8K includes the corresponding cleaning blades 14Y, 14C, 14M, and 14K, which removes the waste toner 91 remaining on the photoconductors 3Y, 3C, 3M, and 3K after transferring the toner image to the transfer sheet 87 to clean the corresponding photoconductors 3Y, 3C, 3M, and 3K.

The waste toner 91 removed from the photoconductors 3Y, 3C, 3M, and 3K by the cleaning blades 14Y, 14C, 14M, and 14K is transported outside of the cleaning devices 8Y, 8C, 8M, and 8K using cleaning device screws 15Y, 15C, 15M, and 15K disposed in the corresponding cleaning devices 8Y, 8C, 8M, and 8K. The waste toner 91 transported by the cleaning device screws 15Y, 15C, 15M, and 15K is transported to an inside of the waste toner container 31, accommodated in the accommodation unit 18, at last, and then accumulated in the waste toner container 31.

Figure 2:
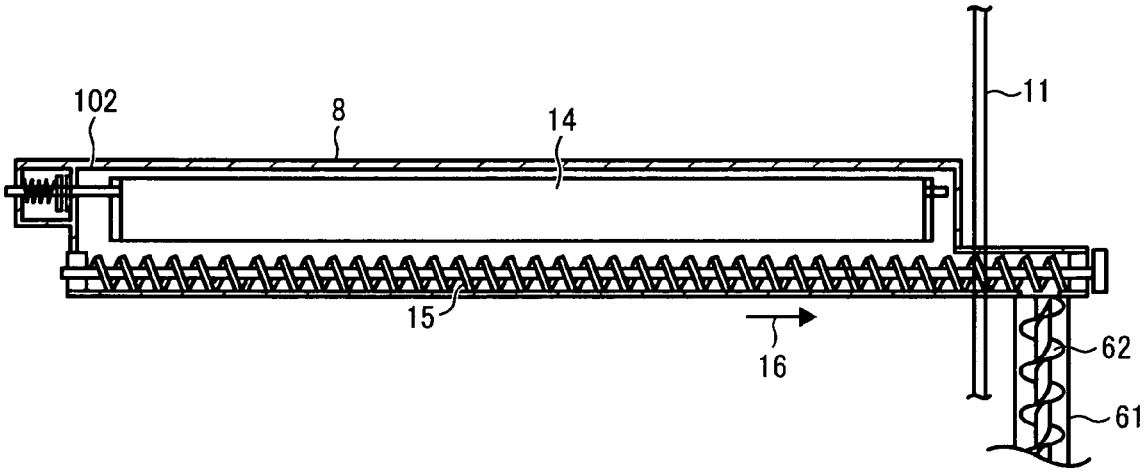
FIG. 2 shows a waste toner transport route in a cleaning unit.

FIG. 2 shows a cross sectional view of the cleaning devices 8Y, 8C, 8M, and 8K viewed from one side of the image forming apparatus 100. Each of the cleaning devices 8Y, 8C, 8M, and 8K includes the corresponding cleaning blades 14Y, 14C, 14M, and 14K and the corresponding cleaning device screws 15Y, 15C, 15M, and 15K in a case 102, in which each of the cleaning blades 14Y, 14C, 14M, and 14K is disposed at an upper side, and each of the cleaning device screws 15Y, 15C, 15M, and 15K is disposed at a lower side of each of the cleaning blades 14Y, 14C, 14M, and 14K. Each of the cleaning devices 8Y, 8C, 8M, and 8K is connected to corresponding vertical toner transport routes 61Y, 61C, 61M, and 61K at a downstream end of the cleaning device screws 15Y, 15C, 15M, and 15K, which transport the waste toner 91 in a direction shown by an arrow 16 in FIG. 2.

The waste toner 91 removed from the photoconductors 3Y, 3C, 3M, and 3K by each of the cleaning blades 14Y, 14C, 14M, and 14K falls down in each of the cleaning devices 8Y, 8C, 8M, and 8K, and then the waste toner 91 is transported by the corresponding cleaning device screws 15Y, 15C, 15M, and 15K in a direction shown by an arrow 16 in FIG. 2. Further, the waste toner 91 of each color is ejected to the vertical toner transport routes 61Y, 61C, 61M, and 61K, disposed outside of the corresponding cleaning devices 8Y, 8C, 8M, and 8K.

Figure 3:
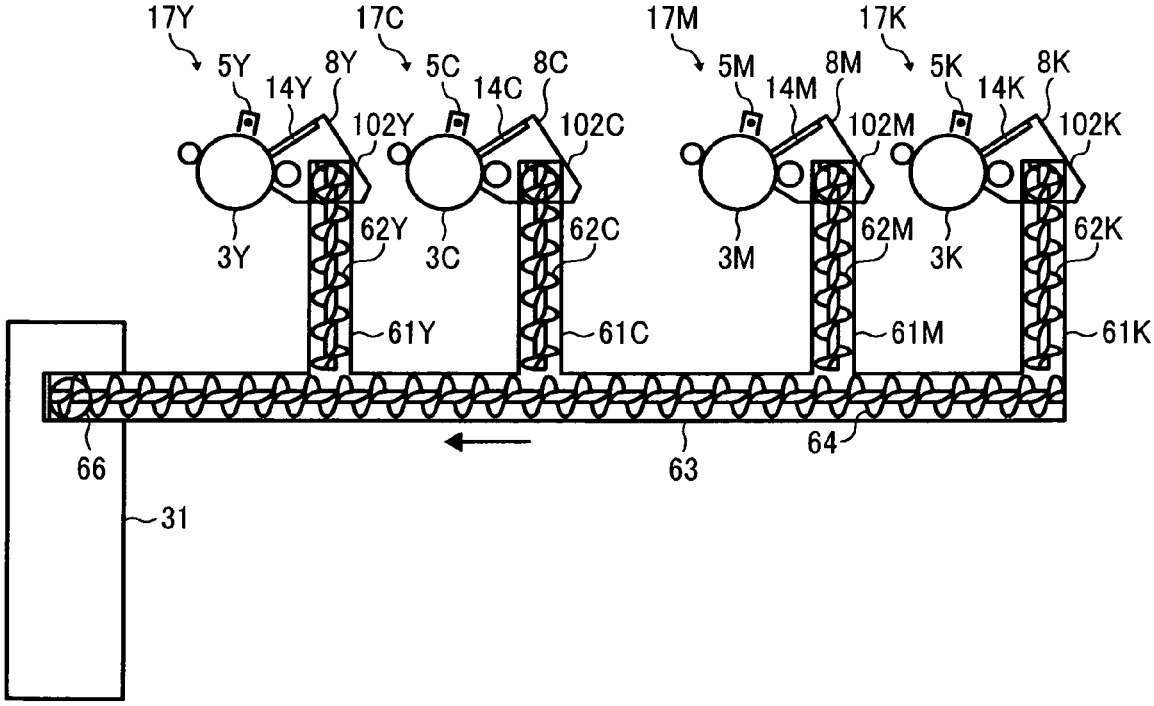
FIG. 3 shows a waste toner transport route of waste toner ejected from the cleaning unit.

FIG. 3 shows a transport route of the waste toner 91 from the cleaning devices 8Y, 8C, 8M, and 8K to the waste toner container 31. Each of the vertical toner transport routes 61Y, 61C, 61M, and 61K, extending in a substantially vertical direction, is connected to the corresponding cleaning devices 8Y, 8C, 8M, and 8K. Each of the vertical toner transport routes 61Y, 61C, 61M, and 61K includes vertical toner transport screws 62Y, 62C, 62M, and 62K therein to transport (or move) the waste toner 91 of corresponding color toner in a downward direction.

Each of the vertical toner transport screws 62Y, 62C, 62M, and 62K is connected to a horizontal toner transport route 63 at a downstream end of transport direction of the waste toner 91 to supply the waste toner 91 of each color to a horizontal toner transport route 63. The horizontal toner transport route 63 includes a horizontal toner transport screw 64 therein, in which the waste toner 91 of each color supplied from the vertical toner transport screws 62Y, 62C, 62M, and 62K may be mixed and transported in a substantially horizontal direction as shown by an arrow in FIG. 3 to the waste toner container 31.

The horizontal toner transport route 63 is connected to a transport-direction switching unit 66 at a downstream end of transport direction of the waste toner 91. The transport-direction switching unit 66, connected to the horizontal toner transport route 63 with a substantially vertical manner, changes a transport direction of the waste toner 91 from a horizontal direction in the horizontal toner transport route 63 to a vertical direction, substantially perpendicular to the horizontal direction. The transport-direction switching unit 66 is disposed in the accommodation unit 18, and functions as a connection unit with the waste toner container 31.

Figure 4:
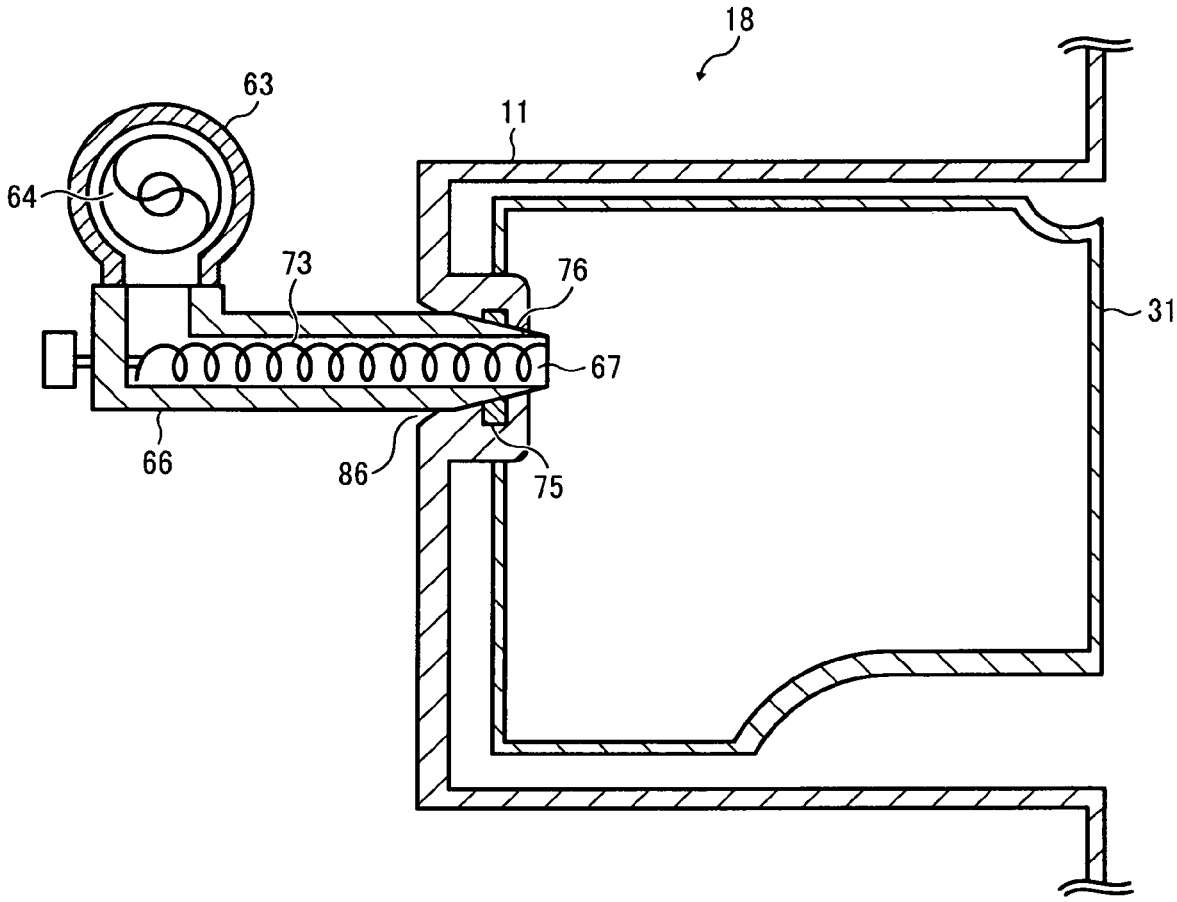
FIG. 4 shows a connection part of waste toner transporting device and a waste toner container.

FIG. 4 shows a detailed cross sectional view of the transport-direction switching unit 66. The transport-direction switching unit 66 may be disposed at a rear side of the apparatus 1 in the accommodation unit 18, and includes the a waste toner transport screw 73 to move or transport the waste toner 91, and an connection unit 67 connectable to the waste toner container 31.

On one hand, the waste toner container 31 includes a waste toner supply port 86 at an upper part of the waste toner container 31, to which the connection unit 67 of the transport-direction switching unit 66 can be inserted. As such, the connection unit 67 may be used as an inserting unit, device, or member.

When the waste toner container 31 is mounted in the accommodation unit 18 of the apparatus 1, the connection unit 67 of the transport-direction switching unit 66 is inserted into the waste toner supply port 86 of the waste toner container 31, by which the waste toner container 31 and the transport-direction switching unit 66 can be connected each other.

The waste toner supply port 86 may include a seal member 75 at a connection part of the connection unit 67 of the transport-direction switching unit 66. The seal member 75 seals a connection portion of the waste toner supply port 86 and the connection unit 67 of the transport-direction switching unit 66 to prevent leakage of the waste toner 91 to outside of the waste toner container 31 from the waste toner supply port 86.

The waste toner 91 is transported in the horizontal toner transport route 63 in the apparatus 1 to the transport-direction switching unit 66 in a transport direction shown by an arrow in FIG. 3 (such as for example from right to left in FIG. 3). Then, the transport-direction switching unit 66 changes a transport direction of the waste toner 91 from the horizontal direction to a direction, perpendicular to the horizontal transport direction in the horizontal toner transport route 63, by which the waste toner 91 can be transported, for example, from the rear side to the front side of the apparatus 1 in FIG. 3. Because the connection unit 67, disposed at a downstream end of transport direction of the waste toner 91 of the transport-direction switching unit 66, is connected to the waste toner supply port 86 disposed for the waste toner container 31, the waste toner 91 transported from the cleaning devices 8Y, 8C, 8M, and 8K through each of the vertical toner transport routes 61Y, 61C, 61M, and 61K, the horizontal toner transport route 63, and the transport-direction switching unit 66, can be ejected in the waste toner container 31.

Figure 5A:
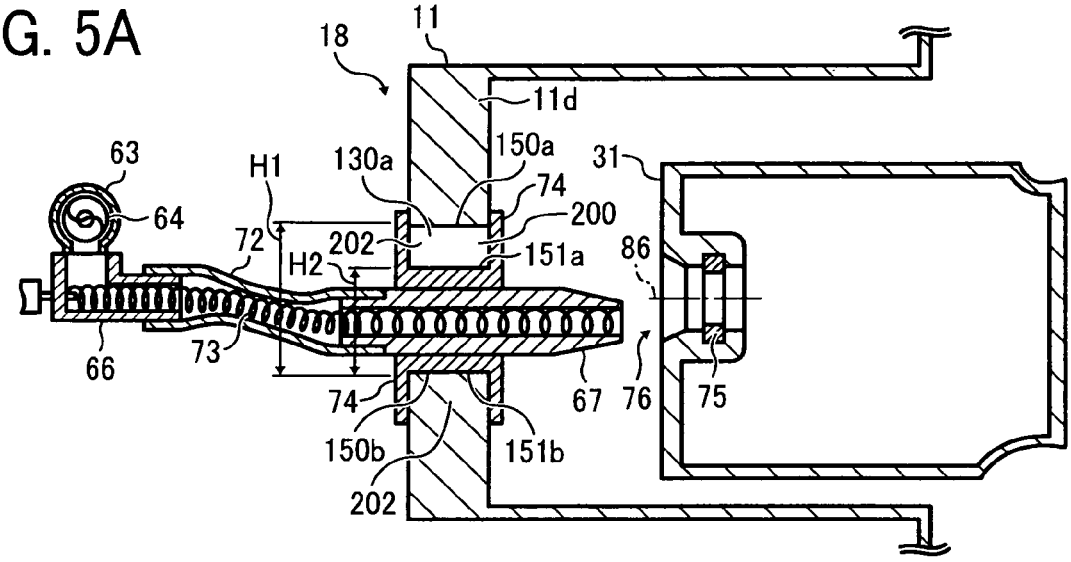
FIGS. 5A, 5B, and 5C show a connection part of waste toner transporting device and a waste toner container.
Figure 5B:
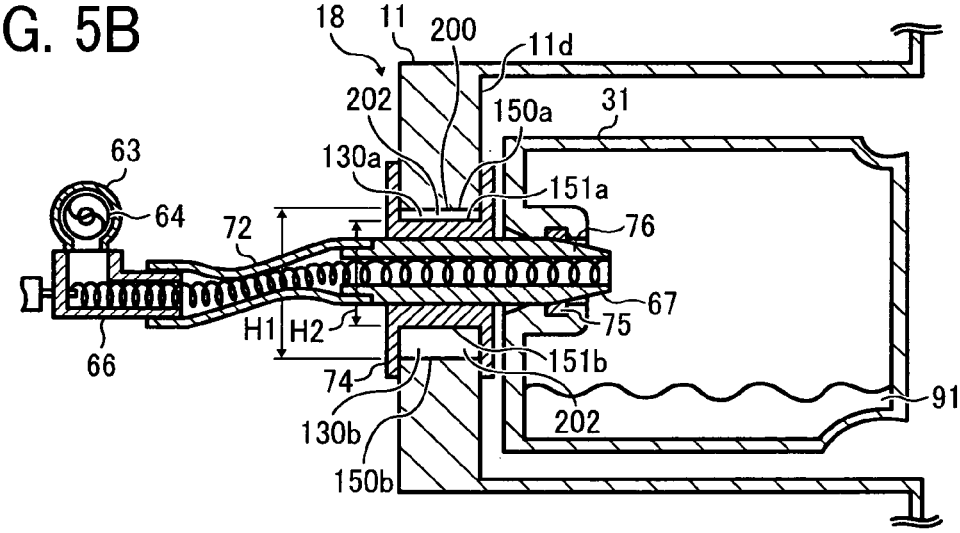
Figure 5C:
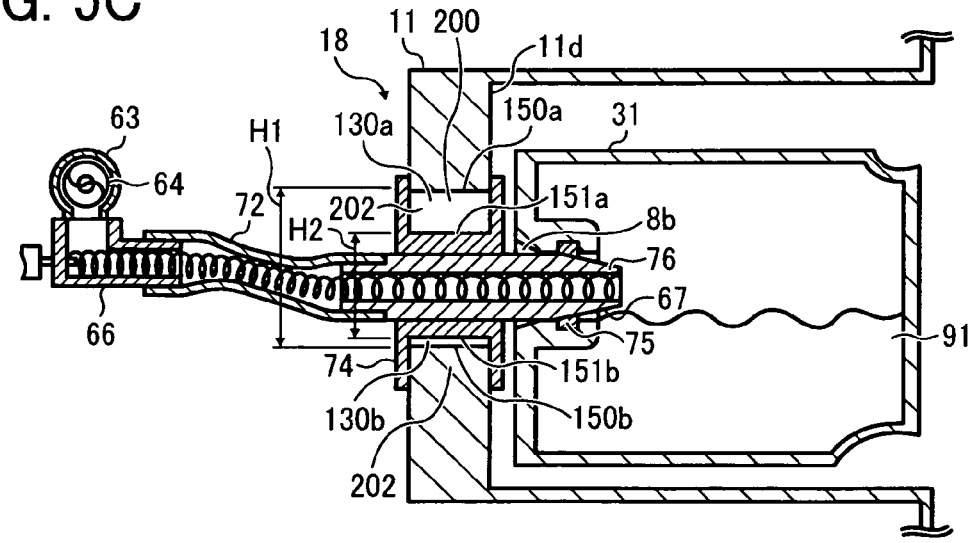

FIGS. 5A to 5C show a configuration of a support structure disposed in the accommodation unit 18, which supports the connection unit 67 of the transport-direction switching unit 66. FIG. 5A shows one condition that the connection unit 67 is disconnected from a connection member 76 of the waste toner container 31.

FIG. 5B shows a supporting position of the connection unit 67 when the connection unit 67 and the connection member 76 are connected to each other when an amount of waste toner 91 collected or accumulated in the waste toner container 31 is small, in which the waste toner container 31 is positioned at a relatively upper side in the accommodation unit 18.

FIG. 5C shows a supporting position of the connection unit 67 when the connection unit 67 and the connection member 76 are connected to each other when an amount of waste toner 91 accumulated in the waste toner container 31 is great, in which the waste toner container 31 is positioned at a relatively lower side in the accommodation unit 18 compared to a position shown in FIG. 5B.

The accommodation unit 18 of the apparatus 1 may include a slider 74 that can support the connection unit 67. The transport-direction switching unit 66 and the connection unit 67 may be connected with each other by a flexible tube 72, which can change its position in a flexible manner. The flexible tube 72 is used as one part of waste toner transport route. The connection unit 67 may be supported by the slider 74, provided on a wall face of a back frame 11*d* of the accommodation unit 18. The slider 74 may be formed in an I-shaped form, and a hole runs through a center of the slider 74 to insert the connection unit 67 in the hole. A wall face of the back frame 11*d* in the accommodation unit 18 is formed of an opening 200 to which the slider 74 is fitted, and each end of the slider 74 can be fitted to each of a wall upper face 150*a* and a wall lower face 150*b* of the opening 200. Specifically, two grooves 202, set at each end of the slider 74 having I-shaped form, fit to the wall upper face 150*a* and the wall lower face 150*b* of the accommodation unit 18 while setting clearances 130*a* and 130*b*, respectively. Accordingly, the slider 74 can be supported in the back frame 11*d* of the accommodation unit 18 so that the slider 74 can move in the up-and-down direction in a wall of the back frame 11*d* within a space set as the clearances 130*a* and 130*b*.

Specifically, when the slider 74 moves to the upper-most position in the opening 200, an upper-groove bottom face 151*a* of groove 202 of the slider 74 contacts the wall upper face 150*a* of a wall face of the back frame 11*d*, and when the slider 74 moves to the down-most position in the opening 200, a lower-groove bottom face 151*b* of groove 202 of the slider 74 contacts the wall lower face 150*b* of a wall face of the back frame 11*d*.

When a distance from the wall upper face 150*a* to the wall lower face 150*b* in the accommodation unit 18 (i.e., height of the opening 200) is set as height H1, and distance from the upper-groove bottom face 151*a* to the lower-groove bottom face 151*b* of slider 74 is set as distance H2, the slider 74 can be moved for a distance defined by an equation of "height H1−distance H2." Accordingly, the slider 74 can be moved in the opening 200 to up-and-down direction for a distance, which corresponds to distance defined by adding a distance of each of the clearances 130*a* and 130*b*.

By providing the slider 74 for the accommodation unit 18 of the apparatus 1, the connection unit 67 can be moved in the up-to-down/down-to-up direction with respect to a wall face of the back frame 11*d* of the accommodation unit 18. Further, because the transport-direction switching unit 66 and the connection unit 67 are connected each other by the flexible tube 72, which can change its position in a flexible manner, the connection unit 67 can be moved to the up-to-down/down-to-up direction with the slider 74 with respect to the transport-direction switching unit 66.

Accordingly, even if an amount of waste toner 91 in the waste toner container 31, mounted in the accommodation unit 18, increases and an arrangement height of the waste toner container 31 in the accommodation unit 18 changes as shown in FIG. 5C, a height position of the connection unit 67 can be changed in response to a change of arrangement height of the waste toner container 31, by which a connected condition between the waste toner container 31 and the connection unit 67 can be maintained.

Figure 6A:
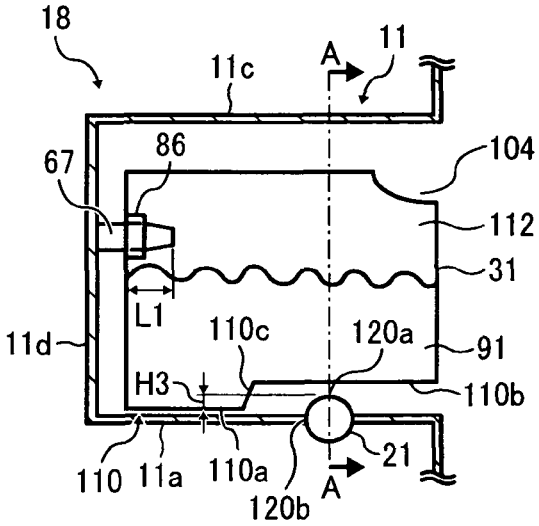
FIGS. 6A, 6B, 6C, 6D and 6E show a dis-mounting movement of a waste toner container with an accommodation unit.
Figure 6B:
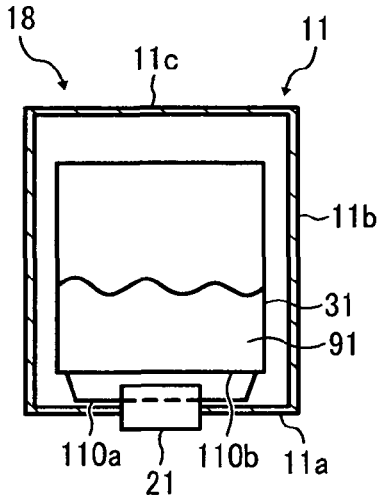
Figure 6C:
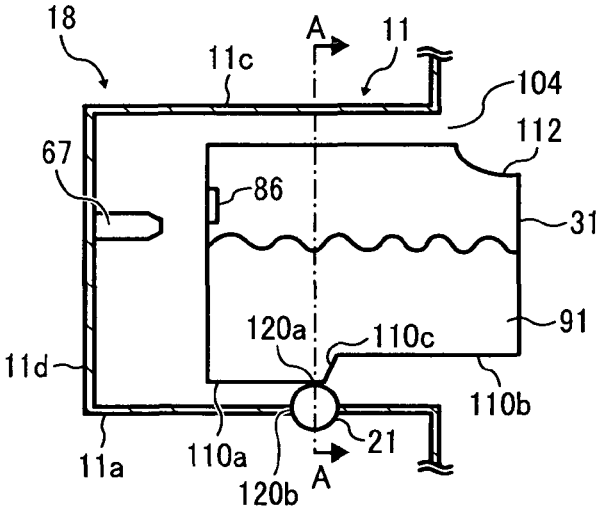
Figure 6D:
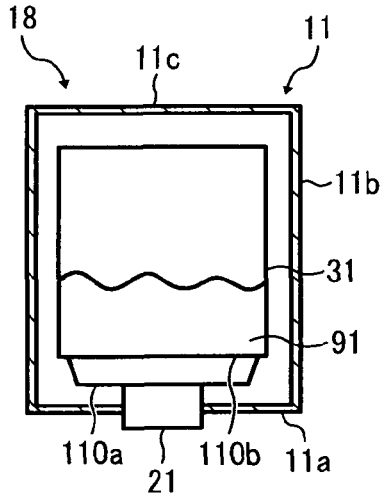
Figure 6E:
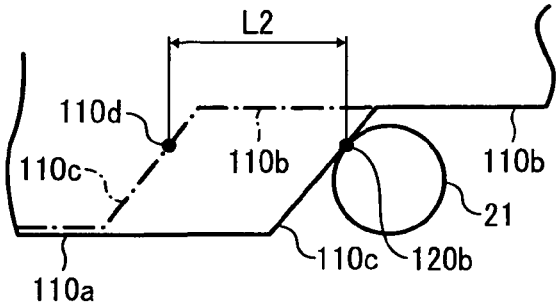

FIGS. 6A to 6E show the accommodation unit 18 according to a first example embodiment. FIGS. 6A and 6B show a schematic condition when the waste toner container 31 is mounted in the accommodation unit 18, and FIGS. 6C and 6D show a schematic condition when the waste toner container 31 is partially withdrawn from the accommodation unit 18 to the exterior of the apparatus 1. FIGS. 6A and 6C show cross sectional views of the accommodation unit 18 and the waste toner container 31 viewed from a lateral side of the apparatus 1, and FIGS. 6B and 6D show cross sectional views of the accommodation unit 18 and the waste toner container 31 viewed from a front side of the apparatus 1, which is cut at the line A-A in FIGS. 6A and 6C corresponding to a position of a reduction device or member. FIG. 6E shows a contact condition of the waste toner container 31 and a reduction device 21 when the waste toner container 31 is partially withdrawn from the accommodation unit 18 to the exterior of the apparatus 1, in which "partially withdrawn" means that the waste toner container 31 is disengaged from a fully mounted position in the accommodation unit 18.

The accommodation unit 18 may include an accommodation frame 11, the connection unit 67 connectable to the transport-direction switching unit 66, and the reduction device 21. The accommodation frame 11 may include the opening 104, a bottom frame 11*a*, a lateral frame 11*b*, a top frame 11*c*, and the back frame 11*d*. Specifically, the lateral frame 11*b* is disposed at both side of the bottom frame 11*a* as a wall, and the top frame 11*c* connects the lateral frames 11*b* at the top edge of lateral frames 11*b* to provide a top frame of the accommodation frame 11. As for the accommodation frame 11, the back frame 11*d* may be disposed at the rear side of the apparatus 1, and the opening 104 may be disposed at the front side of the apparatus 1. The opening 104, the bottom frame 11*a*, the lateral frame 11*b*, the top frame 11*c*, and the back frame 11*d* of the accommodation frame 11 defines a space for accommodating the waste toner container 31.

The connection unit 67 connectable to the transport-direction switching unit 66 is disposed on the back frame 11*d* of the accommodation frame 11, which is at the rear side of the apparatus 1. When the waste toner container 31 is inserted into the accommodation frame 11 from the opening 104 of the accommodation frame 11, which is the front side of the apparatus 1, to the rear side of the apparatus 1, the waste toner supply port 86 of the waste toner container 31 and the connection unit 67 connectable to the transport-direction switching unit 66 can be connected or engaged each other.

The reduction device 21 may be disposed on the bottom frame 11*a* of the accommodation frame 11, in which some part of the reduction device 21 projects from the bottom frame 11*a*. The reduction device 21 is used to reduce a force to withdraw the waste toner container 31 from the interior of the apparatus 1 to the exterior of the apparatus 1. The reduction device 21 may preferably be a rotatable member such as for example a roller, a roll, a gear, or the like. In the bottom frame 11*a* of the accommodation frame 11, the reduction device 21 may be disposed at a given distance from the back frame 11*d* toward the front side of the apparatus 1, which means the reduction device 21 may be disposed at a position distanced from the back frame 11*d* toward the opening 104 for a given distance.

The waste toner container 31 may include the waste toner supply port 86, a grip 112, and a recessed portion 110*b*, for example.

The waste toner supply port 86 is formed at the rear side of the waste toner container 31, and can be connected to the connection unit 67 in the apparatus 1. The grip 112 is formed at a top portion of front side of the waste toner container 31 so that the waste toner container 31 can be gripped easily. The recessed portion 110*b* is formed on a bottom face 110 of the waste toner container 31.

As for the bottom face 110 of the waste toner container 31, the recessed portion 110*b* is formed at a higher position compared to a lower portion 110*a* of the bottom face 110 of the waste toner container 31 as shown in FIG. 6. Specifically, the recessed portion 110*b* is formed on the bottom face 110 of the waste toner container 31 at a position closer to the grip 112 compared to the waste toner supply port 86 of the waste toner container 31. The lower portion 110*a* may be referred to a non-recessed portion.

The waste toner supply port 86 is connected to the connection unit 67, connectable to the transport-direction switching unit 66, when the waste toner container 31 is accommodated in the accommodation unit 18. The waste toner container 31 may have the waste toner supply port 86 at a position facing the back frame 11*d* of the accommodation unit 18, and the grip 112 at a position closer to the opening 104 of the accommodation unit 18.

When the waste toner container 31 is mounted at the mounting-completed position in the accommodation unit 18 (or the waste toner container 31 is mounted at a fully mounted position in the accommodation unit 18), the reduction device 21 is positioned at a position facing the recessed portion 110*b* of the waste toner container 31, in which the reduction device 21 does not contact the bottom face 110 of the waste toner container 31.

On one hand, when the waste toner container 31 is partially withdrawn for a given distance to the exterior of the apparatus 1 as shown in FIG. 6C, the reduction device 21 contacts the lower portion 110*a* of the bottom face 110 of the waste toner container 31, by which the reduction device 21 contacts the bottom face 110 of the waste toner container 31. Accordingly, the reduction device 21 is positioned at a given position that the reduction device 21 contacts the bottom face 110 of the waste toner container 31 when the waste toner container 31 is withdrawn from the mounting-completed position in the accommodation unit 18 for a given distance toward the exterior of the apparatus 1.

When the waste toner container 31 is mounted at the mounting-completed position in the accommodation unit 18, the reduction device 21 is at a position facing the recessed portion 110*b* of the waste toner container 31, and does not contact the bottom face 110 of the waste toner container 31. Accordingly, when the waste toner container 31 is mounted at the mounting-completed position in the apparatus 1, even if the reduction device 21 rotates due to an effect of vibration or the like, unintentional exiting movement such as jumping-out of waste toner container 31 to the exterior of the apparatus 1 due to rotation of the reduction device 21 can be prevented.

Further, when the waste toner container 31 is withdrawn from the mounting-completed position in the accommodation unit 18 for a given distance toward the exterior of the apparatus 1, the reduction device 21 starts to contact the lower portion 110*a* of the bottom face 110 of the waste toner container 31 for the first time.

Accordingly, when the waste toner container 31 is withdrawn toward the exterior of the apparatus 1, the bottom face 110 of the waste toner container 31 contacts the reduction device 21, by which a withdrawing force for withdrawing the waste toner container 31 from the apparatus 1 can be reduced. Therefore, even if the waste toner 91 is collected or accumulated in the waste toner container 31 at a full condition or a nearly-full condition such as for example the accumulated weight becomes several kilograms (kg) or more, the waste toner container 31 can be withdrawn from the apparatus 1 easily. Accordingly, an operator's workforce for replacing the waste toner container 31 can be reduced.

As shown in FIG. 6A, when the waste toner container 31 is in the mounting-completed position in the accommodation unit 18, the connection unit 67 is inserted in the waste toner container 31 for a distance L1 into the waste toner container 31. FIG. 6E shows a partially expanded view of the bottom face 110 of the waste toner container 31 and the reduction device 21. In FIG. 6E, a one-dot dashed line indicates a positional relation of the bottom face 110 of the waste toner container 31 and the reduction device 21 when the waste toner container 31 is mounted at the completed position in the accommodation unit 18, and a solid line indicates a positional relation of the bottom face 110 of the waste toner container 31 and the reduction device 21 when the waste toner container 31 is withdrawn from the accommodation unit 18 and the waste toner container 31 contacts the reduction device 21.

When the waste toner container 31 is partially withdrawn from the accommodation unit 18 in a horizontal direction for a given distance, a portion of the reduction device 21 that contacts an inclined part 110*c* of the waste toner container 31 for the first time is referred to as a contact portion 120*b* of reduction device 21, and a contact portion of the waste toner container 31 that contacts the reduction device 21 is referred to as a contact point 110*d* of the waste toner container 31. The inclined part 110*c* may be also referred to a non-recessed portion. As such, the non-recessed portion such as inclined part 110*c* contacts the reduction device 21 when the waste toner container 31 is partially withdrawn from the accommodation unit 18.

Under a condition when the waste toner container 31 is at the mounting-completed position in the accommodation unit 18, a distance from the contact point 110*d* of the waste toner container 31 to the contact portion 120*b* of reduction device 21 is set as a distance L2, and such distance L2 may be set greater than the inserting distance L1, which is a distance of the connection unit 67 into the waste toner container 31 when the connection unit 67 is inserted in the waste toner container 31 under a condition that when the waste toner container 31 is at the mounting-completed position in the accommodation unit 18.

An arrangement position of the inclined part 110*c* at the bottom face 110 of the waste toner container 31 and an inclination angle of the inclined part 110*c* may be determined so as to set the distance L2 greater than the inserting distance L1. Accordingly, the inclined part 110*c* may be shaped at the bottom face 110 of the waste toner container 31 in a manner that the connection unit 67 can be withdrawn from the waste toner container 31 until the withdrawing waste toner container 31 contacts the reduction device 21. Further, the mounting-completed position of the waste toner container 31 in the accommodation unit 18 is set in a manner that the distance L2 is equal to or greater than the distance L1.

By employing the above described configuration, by the time that the waste toner container 31 is withdrawn in the accommodation unit 18 toward the exterior of the apparatus 1 for the distance L2, the waste toner container 31 moves in a horizontal direction in the accommodation unit 18 for a distance greater than the distance L1, by which the connection member 76 of the waste toner container 31 can be easily separated from the connection unit 67 of the accommodation unit 18.

When the slider 74 shown in FIG. 5 is used as a support member of the connection unit 67, the connection unit 67 can be moved a up-to-down/down-to-up direction in response a up-to-down/down-to-up movement of the waste toner container 31, and the distance L2 can be set shorter than the distance L1. As such, when the slider 74, which can be used as a height adjustment member, is disposed as shown in FIG. 5, the distances L1 and L2 can be set without limitation of relation of distance value for distances L1 and L2.

As shown in FIG. 6A, under a condition that the waste toner container 31 is at the mounting-completed position in the accommodation unit 18 in the apparatus 1, a difference between a height position of the lower portion 110*a*, formed at the bottom face 110 of the waste toner container 31, and a height position of the top portion 120*a* of reduction device 21, which is a top of the reduction device 21, is referred to as a distance H3. The height position of the lower portion 110*a* formed at the bottom face 110 of the waste toner container 31 and the height position of the top portion 120*a* of reduction device 21 in the accommodation unit 18 are set in a manner so that the distance H3 is set equal to or less than a up/down movable distance, which is defined by "H1–H2" for the slider 74 shown in FIG. 5.

By employing the above described configuration, even if the waste toner container 31 is withdrawn for a given distance in the accommodation unit 18 toward the exterior of the apparatus 1 and a height position of the lower portion 110*a* of the waste toner container 31 becomes higher for the distance H3, the slider 74 can move up in the height direction for the distance H3, by which the slider 74 can follow the movement of the waste toner container 31 such as up or down movement of the waste toner container 31. Accordingly, even if an arrangement height of the waste toner container 31 in the accommodation unit 18 changes in a up/down direction, a height position of the connection unit 67 can be changed in response to a change of arrangement height of the waste toner container 31, by which a connected condition between the waste toner container 31 and the connection unit 67 can be maintained.

Second Example Embodiment

FIGS. 7 to 9 show a second example embodiment for the accommodation unit 18. The accommodation unit 18 according to the second example embodiment may further include the swing plate 42 in addition to the reduction device 21 such as a rotatable member including a roller, a roll, a gear or the like used for the first example embodiment shown in FIG. 6. FIGS. 7A to 7E show the accommodation unit 18 accommodating the waste toner container 31, in which an accumulation amount of the waste toner 91 in the waste toner container 31 is small. FIGS. 8A to 8D show the accommodation unit 18 accommodating the waste toner container 31, in which an accumulation amount of the waste toner 91 in the waste toner container 31 is great.

The accommodation unit 18 may include a swing plate 42, which is disposed at a position facing the recessed portion 110*b* of the bottom face 110 of the waste toner container 31 when the waste toner container 31 is at the mounting-completed position in the accommodation unit 18. As shown in FIGS. 7B and 7D, the swing plate 42, which is formed in a plate shape, may be disposed at each lateral side of the reduction device 21. Further, as shown in FIGS. 7A and 7C, in an attachment/detachment direction of the waste toner container 31 in the accommodation unit 18, the swing plate 42 includes a fulcrum 42*a* at a position closer to a rear side of the apparatus 1 with respect to the arrangement position of the reduction device 21 in the accommodation frame 11, and the swing plate 42 can swing in the up-to-down/down-to-up direction about the fulcrum 42*a*.

Further, the swing plate 42 may include a biasing member 41 at a position closer to the front side of the apparatus 1 with respect to the arrangement position of the reduction device 21 in the accommodation frame 11. The biasing member 41 biases the swing plate 42 about the fulcrum 42*a* of the swing plate 42 toward the waste toner container 31 in an upward direction in a vertical direction.

Further, the swing plate 42 may include one end portion supported by the fulcrum 42*a* and a swing end portion 42*c* at the other end portion of the swing plate 42. The swing end portion 42*c* is disposed at a position closer to the opening 104 of the accommodation unit 18 with respect to the arrangement position of the reduction device 21 in the accommodation frame 11. A stopper 160 is disposed at a lower face portion 11*a* of the accommodation frame 11 to prevent the swing end portion 42*c* to project over an upper side of the lower face portion 11*a* of the accommodation frame 11 because if the swing end portion 42*c* projects over the upper side of the lower face portion 11*a* of the accommodation frame 11, the swing end portion 42*c* may hinder an inserting operation of the waste toner container 31 into the accommodation unit 18. With such a configuration, the swing end portion 42*c* may not project over the upper side of the lower face portion 11*a* of the accommodation frame 11, and thereby the swing end portion 42*c* may not block an inserting operation of the waste toner container 31 into the accommodation unit 18.

Figure 7A:
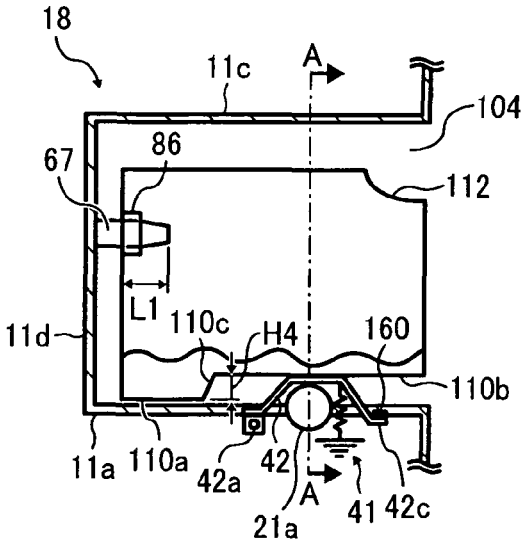
FIGS. 7A, 7B, 7C, 7D and 7E show a dis-mounting movement of a waste toner container with an accommodation unit having a swing plate when an amount of waste toner in waste toner container is small.
Figure 7B:
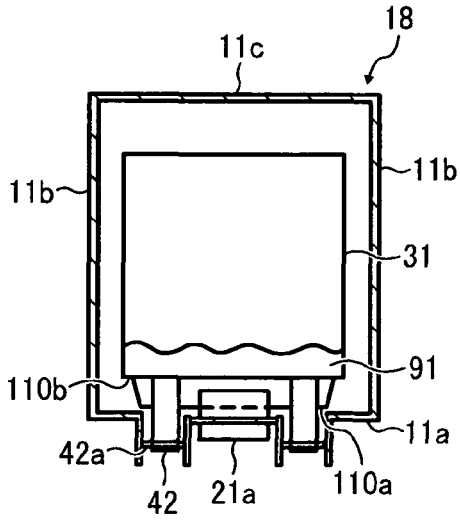
Figure 7C:
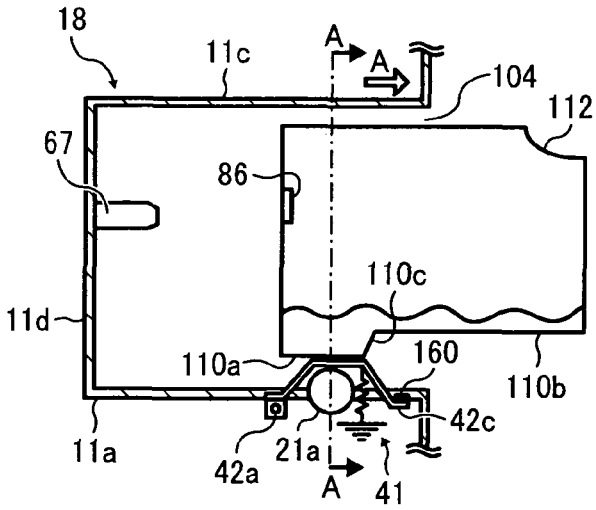
Figure 7D:
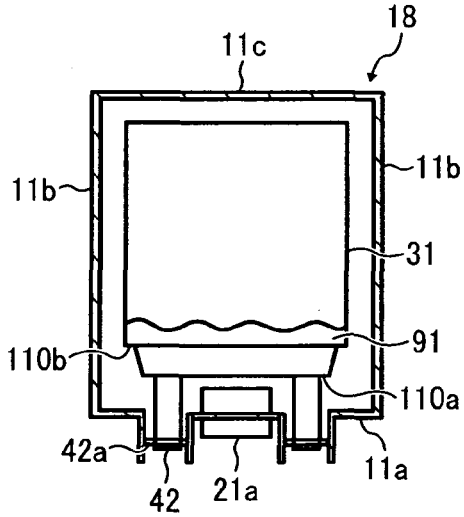

As shown in FIGS. 7A and 7B, the swing plate 42 is biased toward the upward by the biasing member 41. If an accumulation amount of the waste toner 91 accumulated in the waste toner container 31 is smaller than a given amount, which means the waste toner container 31 is lighter than a given weight, the top face of the swing plate 42 is positioned higher than the top face of the reduction device 21. In such a case, the top face of the reduction device 21 is positioned lower than the top face of the swing plate 42. In such a case, when the waste toner container 31 is to be withdrawn from the accommodation unit 18 toward the exterior of the apparatus 1, the lower portion 110*a* of the bottom face 110 of the waste toner container 31 contacts the swing plate 42, but the waste toner container 31 does not contact the reduction device 21.

Accordingly, as shown in FIGS. 7C and 7D, when the waste toner container 31 is withdrawn in a direction toward the exterior of the apparatus 1 for a distance greater than the given distance L3, the lower portion 110*a* of the bottom face 110 of the waste toner container 31 contacts the swing plate 42 while the reduction device 21 does not contact the bottom face 110 of the waste toner container 31.

On one hand, as shown in FIGS. 8A to 8D, when the waste toner 91 accumulates in the waste toner container 31 with a given amount or more, due to the effect of weight of the waste toner container 31 that may become greater than a biasing force of the biasing member 41, the swing plate 42 may swing to the downward direction about the fulcrum 42*a*. When the swing plate 42 swings to the downward direction due to the effect of weight of the waste toner container 31, the top face of the reduction device 21 may become a same level of the top face of the swing plate 42, by which the top face of the reduction device 21 can contact the waste toner container 31.

Accordingly, when the waste toner container 31 accumulates the waste toner 91 for a given amount or more, and a weight of the waste toner container 31 becomes a given weight or more, the swing plate 42 may swing to the downward direction due to the effect of weight of the waste toner container 31, and a height of the top face of the reduction device 21 may become a same level of the top face of the swing plate 42. Accordingly, as shown in FIGS. 8C and 8D, when the waste toner container 31 is withdrawn in a direction toward the exterior of the apparatus 1 for a given distance, the reduction device 21 contacts the lower portion 110*a* of the bottom face 110 of the waste toner container 31, by which a withdrawing force required for withdrawing the waste toner container 31 from the interior of the apparatus 1 to the exterior of the apparatus 1 can be reduced.

Accordingly, when the weight of waste toner container 31 becomes a given weight or more, the reduction device 21 can be used to reduce a withdrawing force required for withdrawing the waste toner container 31 from the interior of the apparatus 1 to the exterior of the apparatus 1.

When the weight of waste toner container 31 is lighter than a given weight, the reduction device 21 may not reduce a withdrawing force required for withdrawing the waste toner container 31 from the interior of the apparatus 1 to the exterior of the apparatus 1. Accordingly, even if the image forming apparatus 100 vibrates, unintended guidance (such as jumping-out bouncing-out) of the waste toner container 31 to the exterior of the apparatus 1 by the reduction device 21 can be prevented.

In FIGS. 7 and 8, the biasing member 41 may use a compression spring, but other springs such as extension spring, tension spring, screw spring, or the like can be used. Further, the swing plate 42 and the biasing member 41 may be, for example, integrally formed using a leaf spring or the like, but not limited thereto.

Figure 7E:
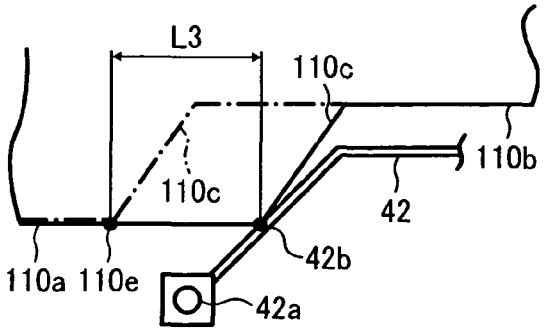

As shown in FIG. 7A, when the waste toner container 31 is set at the mounting-completed position in the accommodation unit 18, the connection unit 67 of the accommodation unit 18 is inserted into the waste toner container 31 for the distance L1. FIG. 7E shows a partially expanded view of the bottom face 110 of the waste toner container 31 and the swing plate 42. In FIG. 7E, a one-dot dashed line indicates a positional relation of the bottom face 110 of the waste toner container 31 and the swing plate 42 when the waste toner container 31 is mounted at the mounting-completed position in the accommodation unit 18, and a solid line indicates a positional relation of the bottom face 110 of the waste toner container 31 and the swing plate 42 when the waste toner container 31 is withdrawn from the accommodation unit 18 and the waste toner container 31 contacts the swing plate 42.

When the waste toner container 31 is withdrawn from the accommodation unit 18 in a horizontal direction, a portion of the swing plate 42 that contacts the inclined part 110*c* of the waste toner container 31 for the first time is referred to as a swing plate contact point 42*b*, and a portion of the inclined part 110*c* of the waste toner container 31 that contacts the swing plate 42 for the first time is referred to as a waste toner container contact point 110*e*. Under a condition when the waste toner container 31 is at the mounting-completed position in the accommodation unit 18, a distance from the waste toner container contact point 110*e* of the waste toner container 31 to the swing plate contact point 42*b* of the swing plate 42 is set as a distance L3, and such distance L3 may be set greater than the inserting distance L1, which is a distance of the connection unit 67 into the waste toner container 31 when the connection unit 67 is inserted in the waste toner container 31 under a condition that the waste toner container 31 is at the mounting-completed position in the accommodation unit 18. The inclined part 110*c* is formed for the waste toner container 31 so as to set the distance L3 greater than the inserting distance L1. Further, the mounting-completed position of the waste toner container 31 in the accommodation unit 18 is set in a manner that the distance L3 is equal to or greater than the distance L1.

By employing the above described configuration, by the time that the waste toner container 31 is withdrawn in the accommodation unit 18 toward the exterior of the apparatus 1 for the distance L3, the waste toner container 31 moves in a horizontal direction in the accommodation unit 18 for a distance greater than the distance L1, and the waste toner container 31 may not move in the up-to-down/down-to-up direction during such horizontal movement, by which the connection member 76 of the waste toner container 31 can be easily separated from the connection unit 67 of the accommodation unit 18.

When the slider 74 shown in FIG. 5 is used as a support member of the connection unit 67, the connection unit 67 can be moved a up-to-down/down-to-up direction in response a up-to-down/down-to-up movement of the waste toner container 31, and the distance L3 can be set shorter than the distance L1. As such, when the slider 74, which can be used as a height adjustment member, is disposed as shown in FIG. 5, the distances L1 and L3 can be set without limitation of relation of distance value for distances L1 and L3.

Figure 8A:
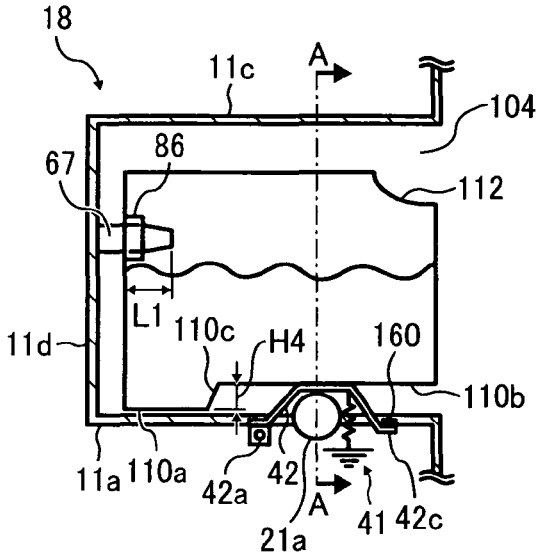
FIGS. 8A, 8B, 8C, and 8D show a dis-mounting movement of a waste toner container with an accommodation unit having a swing plate when an amount of waste toner in waste toner container is great.
Figure 8B:
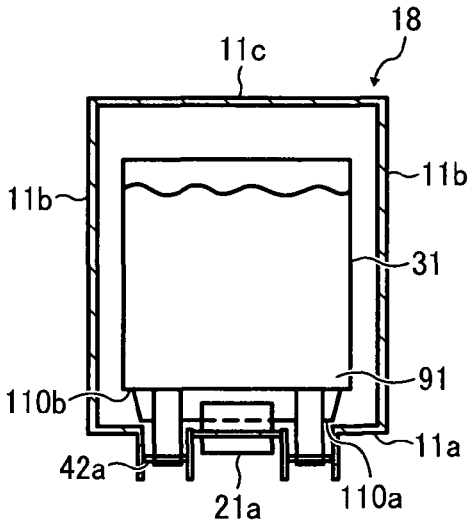
Figure 8C:
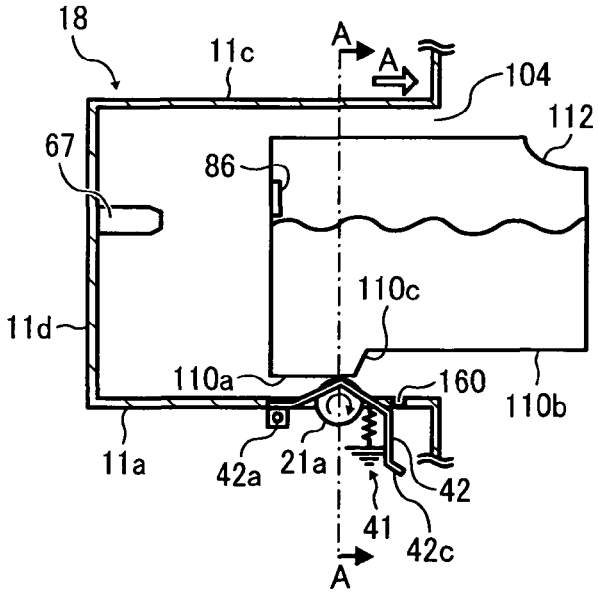
Figure 8D:
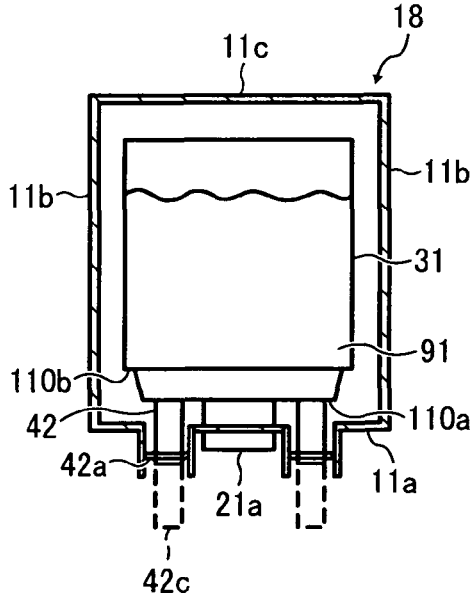

As shown in FIG. 8A, under a condition that the waste toner container 31 is at the mounting-completed position in the accommodation unit 18 in the apparatus 1, a difference between a height position of the lower portion 110*a*, formed at the bottom face 110 of the waste toner container 31, and a highest height position of the swing plate 42 when the swing plate 42 contacts the stopper 160 is referred to as a distance H4. The height position of the lower portion 110*a* formed at the bottom face 110 of the waste toner container 31 is set in manner so that the distance H4 is set equal to or less than a up/down movable distance, which is defined by "H1−H2" for the slider 74 shown in FIG. 5, by which the height position of the swing plate 42 in the accommodation unit 18 may be set preferably.

By employing the above described configuration, even if the waste toner container 31 is withdrawn for the given distance L3 in the accommodation unit 18 toward the exterior of the apparatus 1, and a height position of the lower portion 110*a* of the waste toner container 31 becomes higher for the distance H4 because the lower portion 110*a* of the waste toner container 31 contacts the swing plate 42 and moves upward, the slider 74 can move up in the height direction for the distance H4, by which the slider 74 can follow the movement of the waste toner container 31 such as up or down movement of the waste toner container 31. Accordingly, even if an arrangement height of the waste toner container 31 in the accommodation unit 18 changes in a up/down direction, a height position of the connection unit 67 can be changed in response to a change of arrangement height of the waste toner container 31, by which a connected condition between the waste toner container 31 and the connection unit 67 can be maintained.

Further, in the second example embodiment, the reduction device 21 may employ a roller 21*a* having a one-way clutch. The roller 21*a* may be a roller or roll, for example. When the one-way clutch is rotated in one direction, a lock condition can be set for clutch. When such one-way clutch is employed for the roller 21*a*, the roller 21*a* may rotate effectively in one direction, but the roller 21*a* may not rotate in the opposite direction. In the second example embodiment, the one-way clutch mechanism is employed for the reduction device 21 to set allowable rotation direction of the roller 21*a*. Specifically, the one-way clutch mechanism allows a rotation of the roller 21*a* when the waste toner container 31 is withdrawn from the interior of the accommodation unit 18 to the exterior of the apparatus 1 (i.e. withdrawing direction), and the one-way clutch mechanism does not allow a rotation of the roller 21*a* when the waste toner container 31 is inserted from the exterior of the apparatus 1 to the interior of the apparatus 1 (i.e. inserting direction).

Figure 9A:
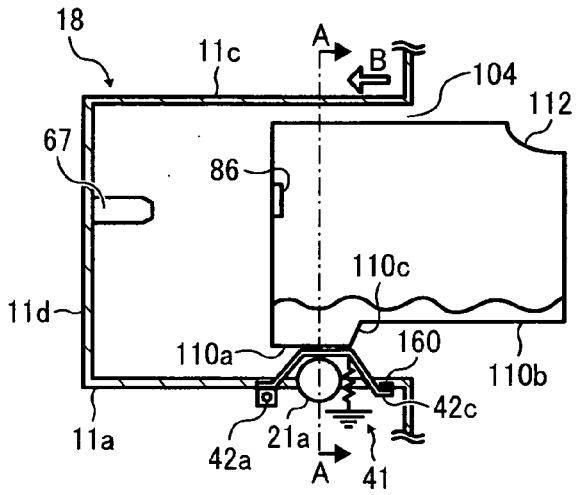
FIGS. 9A, 9B, 9C, and 9D show a mounting movement of a waste toner container with an accommodation unit having a swing plate.
Figure 9B:
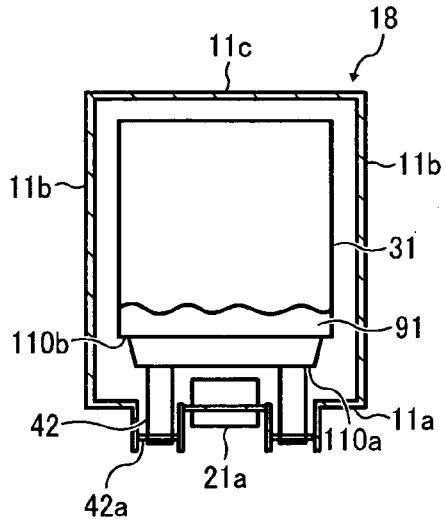

FIGS. 9A to 9D show a condition when the waste toner container 31 is mounted into the accommodation unit 18, in which the waste toner container 31 is partially inserted in the accommodation unit 18. For example, the waste toner container 31 is partially inserted in the middle of the accommodation unit 18. FIGS. 9A and 9B, corresponding to FIGS. 7C and 7D, show a schematic condition of the accommodation unit 18 when an accumulation amount of the waste toner 91 accumulated in the waste toner container 31 is small, and FIGS. 9C and 9D, corresponding to FIGS. 8C and 8D, show a schematic condition of the accommodation unit 18 when an accumulation amount of the waste toner 91 accumulated in the waste toner container 31 is great.

FIGS. 9A and 9B show a schematic condition when the waste toner container 31 is empty or the waste toner container 31 collects or accumulates the waste toner 91 with a smaller amount. When the waste toner container 31 is inserted into the accommodation unit 18 of the apparatus 1 in a direction shown by an arrow B in FIG. 9A, because a pressing force of the waste toner container 31 toward the swing plate 42 is small due to a smaller weight of the waste toner container 31, the top face of the swing plate 42 is positioned above the top face of the reduction device 21, by which the bottom face 110 of the waste toner container 31 does not contact the reduction device 21. Accordingly, the waste toner container 31 does not contact the roller 21*a* having one-way clutch when the waste toner container 31 is inserted into the accommodation unit 18, by which the waste toner container 31 does not receive a resistance force from the roller 21*a*, and the waste toner container 31 can be mounted into the apparatus 1 easily.

Figure 9C:
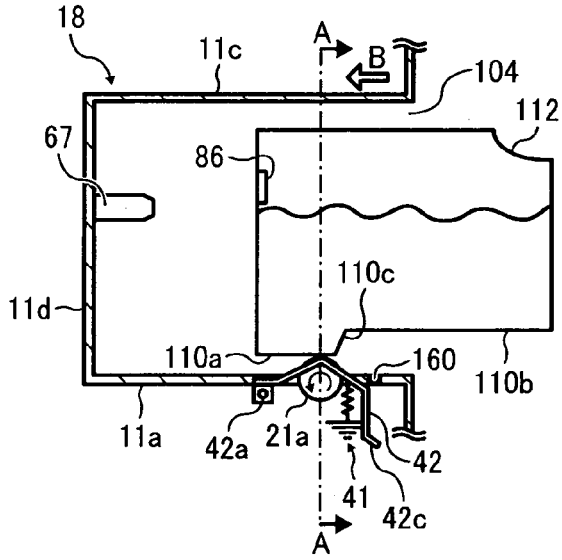
Figure 9D:
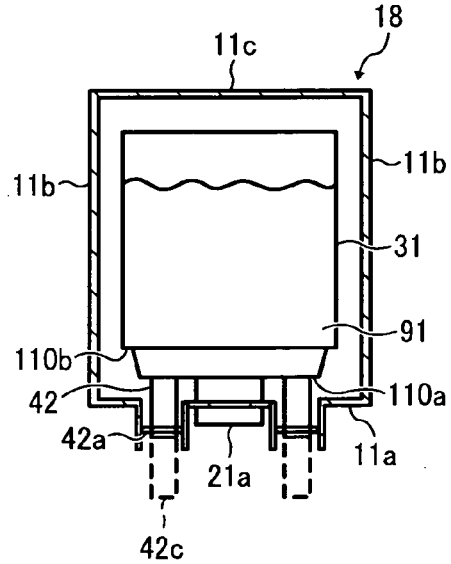

On one hand, FIGS. 9C and 9D show a schematic condition when the waste toner container 31 accumulates the waste toner 91 with a greater amount. When the waste toner container 31 is inserted into the accommodation unit 18 of the apparatus 1 in a direction shown by an arrow B in FIG. 9C, because a pressing force of the waste toner container 31 toward the swing plate 42 becomes great due to a greater weight of the waste toner container 31, the swing plate 42 is pressed into a downward direction by a weight of the waste toner container 31, by which a height of the top face of the reduction device 21 is positioned at a same height of the top face of the swing plate 42. Accordingly, the lower portion 110*a* of the bottom face 110 of the waste toner container 31 contacts the roller 21*a* having one-way clutch. In such a case, when the waste toner container 31 is inserted from the exterior of the apparatus 1 to the interior of the apparatus 1 in a direction shown by an arrow B in FIG. 9C (i.e., inserting direction), the roller 21*a* contacting the waste toner container 31 may not rotate effectively with an effect of one-way clutch.

Specifically, when the waste toner container 31 accumulating the waste toner 91 with a given amount or more is to be mounted in the accommodation unit 18 of the apparatus 1, the one-way clutch of the roller 21*a* prevents a rotation of the roller 21*a* in a direction corresponding to an inserting direction of the waste toner container 31, which is from the exterior to inside of the apparatus 1, by which a mounting of the waste toner container 31 having too much weight of waste toner 91 (or over-weighted waste toner container 31) into the accommodation unit 18 can be prevented. Accordingly, the waste toner container 31 accumulating the waste toner 91 with a given amount or more cannot be re-mounted in the accommodation unit 18 of the apparatus 1. Therefore, a re-mounting of the waste toner container 31 accumulating too much waste toner 91 (such as over-accumulating-capacity conditioned waste toner container 31) into the accommodation unit 18 of the apparatus 1 can be prevented.

As such, in the second example embodiment, the reduction device 21 employs the roller 21*a* having one-way clutch. When the waste toner container 31 accumulating the waste toner 91 with a given amount or more is to be withdrawn from the interior of the apparatus 1 to the exterior of the apparatus 1, the roller 21*a* can rotate as the bottom face 110 of the waste toner container 31 moves, by which when an operator withdraws the waste toner container 31 from the apparatus 1, a withdrawing force required for withdrawing the waste toner container 31 from the apparatus 1 can be reduced. Further, the roller 21*a* having one-way clutch can prevent a re-mounting of the waste toner container 31 accumulating the waste toner 91 with a given amount or more into the accommodation unit 18 of the apparatus 1, and thereby a re-mounting of the waste toner container 31 accumulating too much waste toner into the accommodation unit 18 can be prevented with a simple configuration.

Third Example Embodiment

Figure 10A:
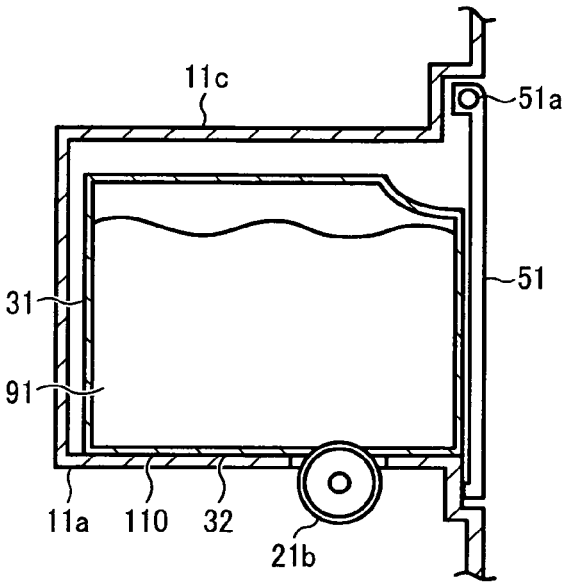
FIGS. 10A and 10B show a reduction device having a gear and a rack.
Figure 10B:
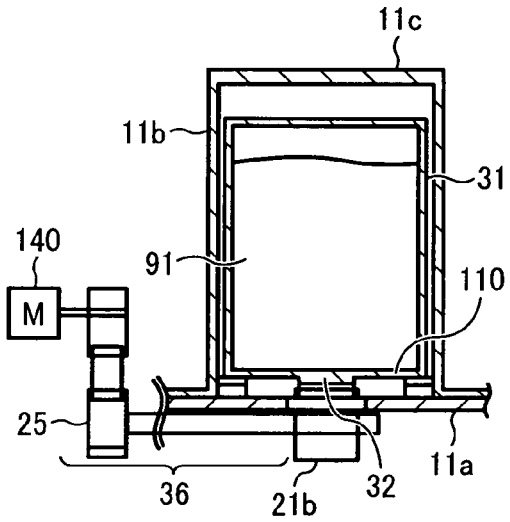

FIGS. 10A and 10B show the accommodation unit 18 according to a third example embodiment. In the accommodation unit 18 according to the third example embodiment, the reduction device 21 includes a gear 21*b* as a rotatable member to contact the bottom face 110 of the waste toner container 31. The bottom face 110 of the waste toner container 31 may include a rack 32 as a meshing portion that meshes with the gear 21*b*. The reduction device 21 further includes a drive power transmission device 36 to transmit a driving force of a drive source 140 of the image forming apparatus 100 to the gear 21*b*. By meshing the gear 21*b* of the accommodation unit 18 and the rack 32 at the bottom face 110 of the waste toner container 31, a driving force of the drive source 140 of the image forming apparatus 100 can be effectively transmitted to the bottom face 110 of the waste toner container 31, by which a withdrawing force for withdrawing the waste toner container 31 from the accommodation unit 18 of the apparatus 1 can be reduced effectively. Further, because a driving force of the drive source 140 of the image forming apparatus 100 is used, the waste toner container 31 can be replaced while the image forming apparatus 100 is under a condition of printing operation.

As such, in the third example embodiment, the reduction device 21 may include the gear 21*b* and the drive power transmission device 36, and the waste toner container 31 may include the rack 32. As for the reduction device 21, the gear 21*b* used as a rotatable member contacts the bottom face 110 of the waste toner container 31, and the drive power transmission device 36 transmits a driving force of the drive source 140 of the image forming apparatus 100 to the gear 21*b* used as a rotatable member. As for the waste toner container 31, the rack 32, formed at the bottom face 110 of the waste toner container 31, is used as a meshing portion that meshes with the gear 21*b* used as a rotatable member.

Further, a driving force can be transmitted to the gear 21*b* of the reduction device 21 using a drive motor, separately provided from the drive source 140 of the image forming apparatus 100. In such a configuration, a switch or the like may be provided for such separately-provided drive motor, by which a user can control the drive motor. When a drive source of the reduction device 21 is disposed separately from the drive source 140 of the image forming apparatus 100 as such, the waste toner container 31 can be efficiently withdrawn to the exterior of the apparatus 1 even if the drive source 140 of the image forming apparatus 100 is not activated.

Fourth Example Embodiment

Figure 11A:
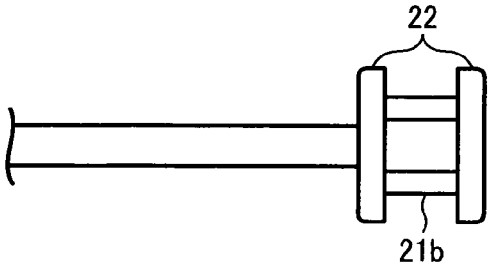
FIGS. 11A and 11B show a gear and a wheel member outside of gear, and a torque limiter to absorb a driving force of gear.
Figure 11B:
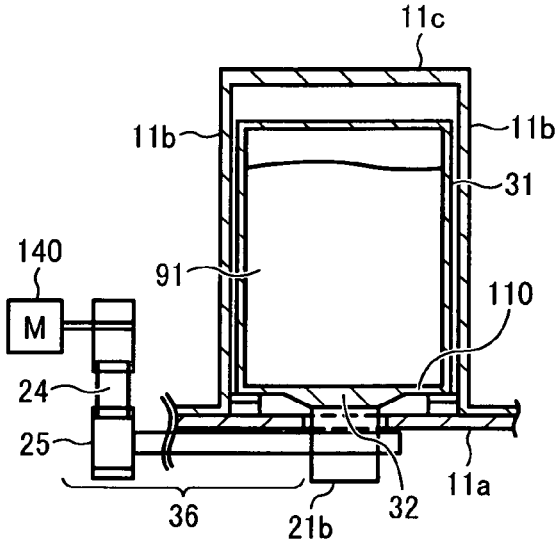

FIGS. 11A and 11B show the accommodation unit 18 according to a fourth example embodiment. The reduction device 21 according to the fourth example embodiment may include a wheel member 22 at the outer side of the gear 21*b* shown in FIG. 10. As shown in FIGS. 11A and 11B, the wheel member 22 is formed at each end of the gear 21*b* connected to the rotation shaft 25, wherein the diameter of the wheel member 22 is set greater than the addendum circle of gear 21*b*, and no teeth is formed on outer surface of the wheel member 22. Such wheel member 22 can be integrally formed with the gear 21*b*. By providing the wheel member 22 at each end of the gear 21*b*, an operator may not mistakenly touch the teeth of the gear 21*b*, which may be in rotation, by which an injury of operator by touching teeth of the gear 21*b* can be prevented.

Further, in the fourth example embodiment, the drive power transmission device 36 may include a torque limiter 24. When the gear 21*b* receives a too-great resistance force, which exceeds a given level, the torque limiter 24 may absorb a driving force. By including the torque limiter 24 for the drive power transmission device 36, when an operator mistakenly contacts the drive power transmission device 36 and/or the gear 21*b* and a too-great resistance force occurs at the drive power transmission device 36, the torque limiter 24 absorbs torque, by which a transmission of driving force from the drive power transmission device 36 to the gear 21*b* can be shutdown. Accordingly, an injury of operator by contacting the drive power transmission device 36 and/or the gear 21*b* can be prevented.

Fifth Example Embodiment

Figure 12A:
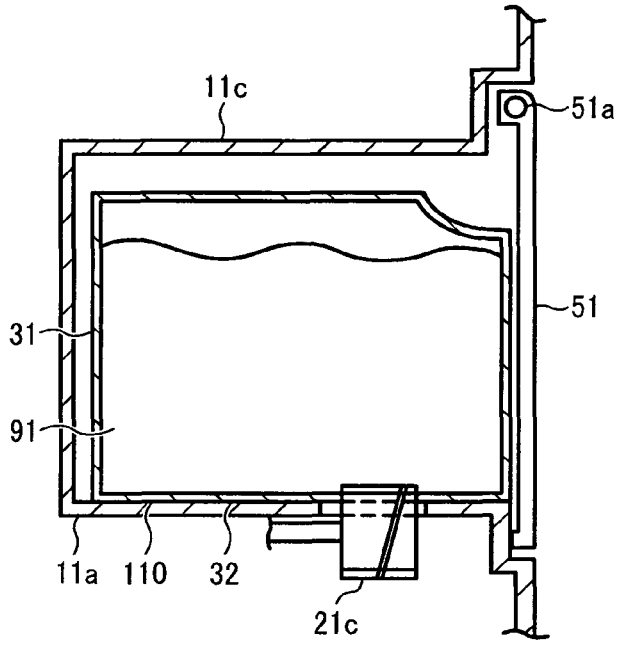
FIGS. 12A and 12B show a reduction device having a worm and a worm wheel.
Figure 12B:
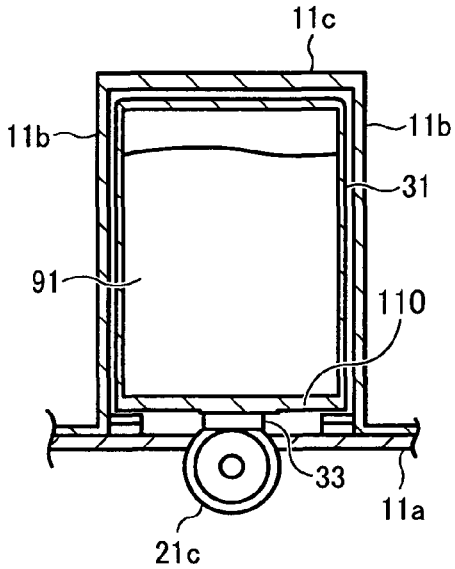

FIGS. 12A and 12B show the accommodation unit 18 according to a fifth example embodiment. The reduction device 21 according to the fifth example embodiment includes a worm wheel 21*c* as a rotatable member. A worm 33 is disposed at the bottom face 110 of the waste toner container 31 and used as a meshing portion that meshes with the worm wheel 21*c* used as a rotatable member. By meshing the worm wheel 21*c* and the worm 33 each other, a driving force supplied from the drive source 140 of the image forming apparatus 100 can be effectively transmitted to the bottom face 110 of the waste toner container 31, by which a withdrawing force required for withdrawing the waste toner container 31 from the interior of apparatus 1 to the exterior of the apparatus 1 can be reduced.

Figure 13:
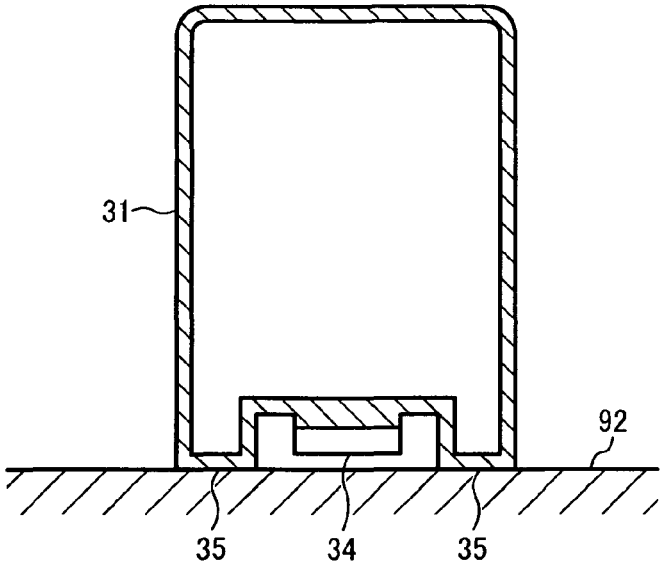
FIG. 13 shows a condition when a waste toner container is placed on a stand face outside an apparatus.

FIG. 13 shows a condition when the waste toner container 31 is placed on a stand face 92 of a desk, a stand, or the like when the waste toner container 31 shown in FIGS. 10 to 12 (third to fifth example embodiments) is withdrawn to the outside of the apparatus 1.

In the above-described third to fifth example embodiments explained with reference to FIGS. 10 to 12, the waste toner container 31 may include a meshing face 34 (see FIG. 13) having a meshing portion at the bottom face 110 of the waste toner container 31 such as rack 32, worm 33, for example. Further, the waste toner container 31 may include a support face 35 projecting to a downward position compared to the meshing face 34, wherein the support face 35 can contact the stand face 92 such as a desk, a stand, or the like to support the waste toner container 31. By providing the support face 35 for the waste toner container 31, when the waste toner container 31 is placed on the stand face 92 (i.e., outside of the apparatus 1), the support face 35 contacts the stand face 92. Accordingly, when the waste toner container 31 is removed from the apparatus 1 and placed on the stand face 92 such as a desk, a stand, or the like, the waste toner container 31 can stand in a stable manner.

Figure 14A:
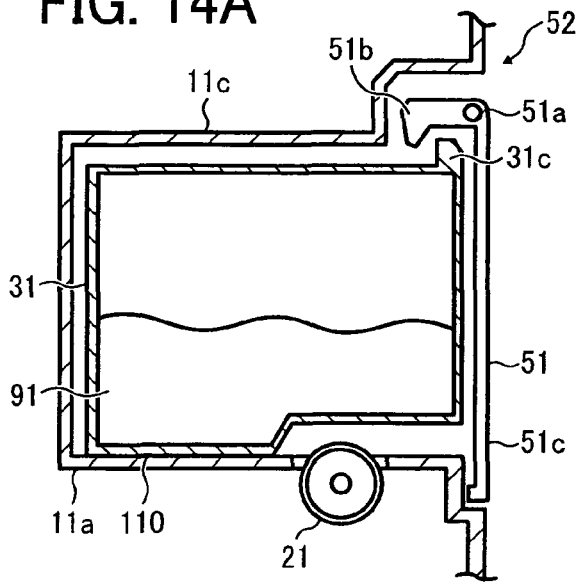
FIGS. 14A, 14B, and 14C show a door disposed for an accommodation unit having an assist unit.
Figure 14B:
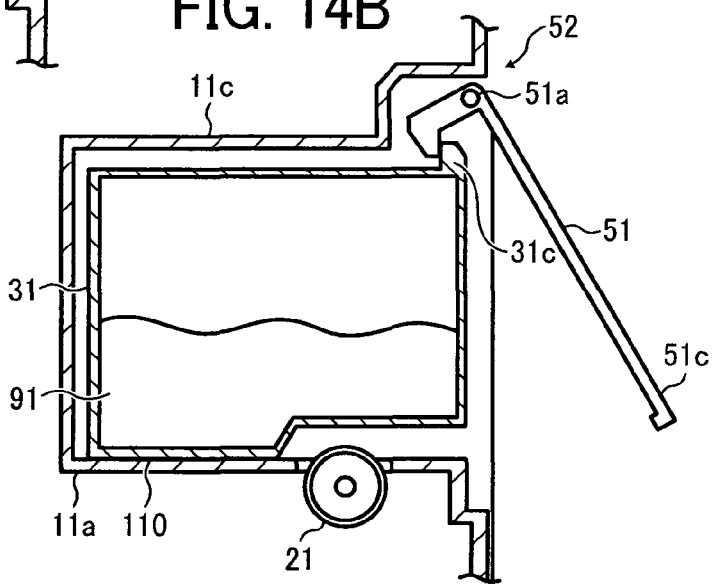
Figure 14C:
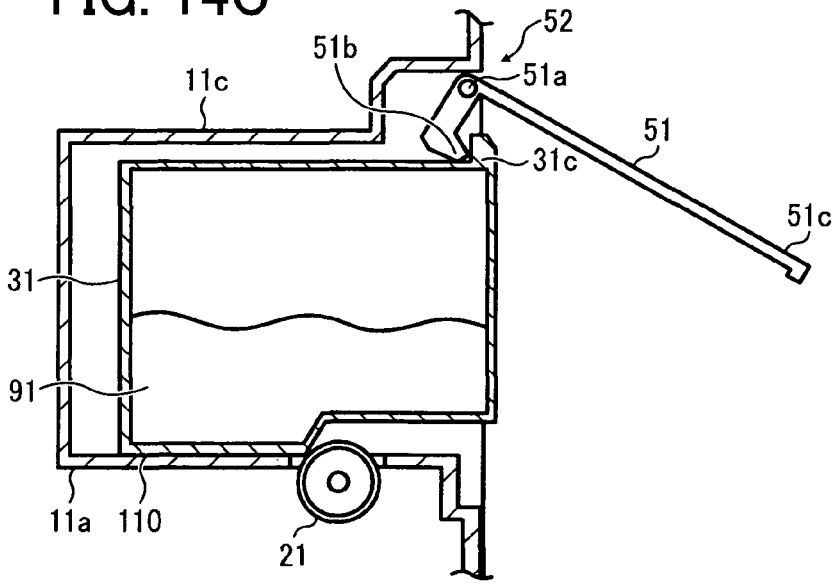

FIGS. 14A to 14C show one example configuration of a door 51 provided for the accommodation unit 18 for the above described example embodiments, in which the accommodation unit 18 is provided with a door 51 at a front side of the apparatus 1. The door 51 may include an assist unit 52, which assists a withdrawing operation of the waste toner container 31 from the interior of the apparatus 1 to the exterior of the apparatus 1. The door 51 is disposed at the front side of the apparatus 1, and a door rotation shaft 51*a* is disposed at a position near the top frame 11*c* of the accommodation frame 11 of the accommodation unit 18, and the position of the door rotation shaft 51*a* is near the front side of the apparatus 1. The door 51 can be opened by rotating the door 51 about the door rotation shaft 51*a*.

The waste toner container 31 includes a concaved portion 31*c* at a position near the front side of the apparatus 1 when the waste toner container 31 is set in the accommodation unit 18. Further, the door 51 includes a withdrawing member 51*b*, used as the assist unit 52, and the withdrawing member 51*b* can engage with the concaved portion 31*c* of the waste toner container 31 when the waste toner container 31 is to be withdrawn to the exterior of the apparatus 1. The door 51 includes the withdrawing member 51*b* at a position near to a top end portion of a cover 51*c*, and the withdrawing member 51*b* is disposed in one direction, which is substantially perpendicular (or about 90 degrees) to a direction that the cover 51*c* extends.

As shown in FIGS. 14A to 14C, when the door 51 is opened, the concaved portion 31*c* of the waste toner container 31 engages with the withdrawing member 51*b* of the door 51. When the door 51 is rotated about the door rotation shaft 51*a* from a condition shown in FIG. 14B to a condition shown in FIG. 14C, the waste toner container 31 can be withdrawn from the accommodation unit 18 to the exterior of the apparatus 1, which is the front side of the apparatus 1.

Because the door 51 includes the assist unit 52, when the waste toner container 31 is withdrawn from the interior of the apparatus 1 to the exterior of the apparatus 1, the waste toner container 31 can be started to move from the mounting-completed position in the accommodation unit 18 toward the exterior of the accommodation unit 18 by just conducting an opening operation of the door 51, in which an operator does not contact or touch the waste toner container 31. Accordingly, a withdrawing force for withdrawing the waste toner container 31 from the interior to the exterior of the apparatus 1 can be reduced.

Figure 15A:
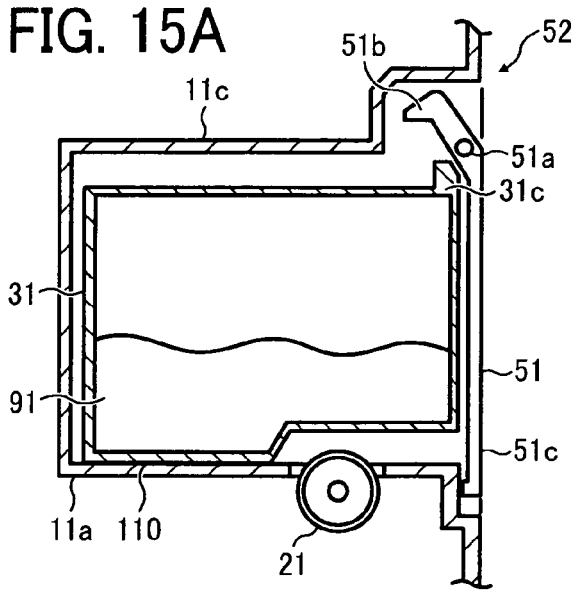
FIGS. 15A, 15B, and 15C show a door disposed for an accommodation unit having another assist unit.
Figure 15B:
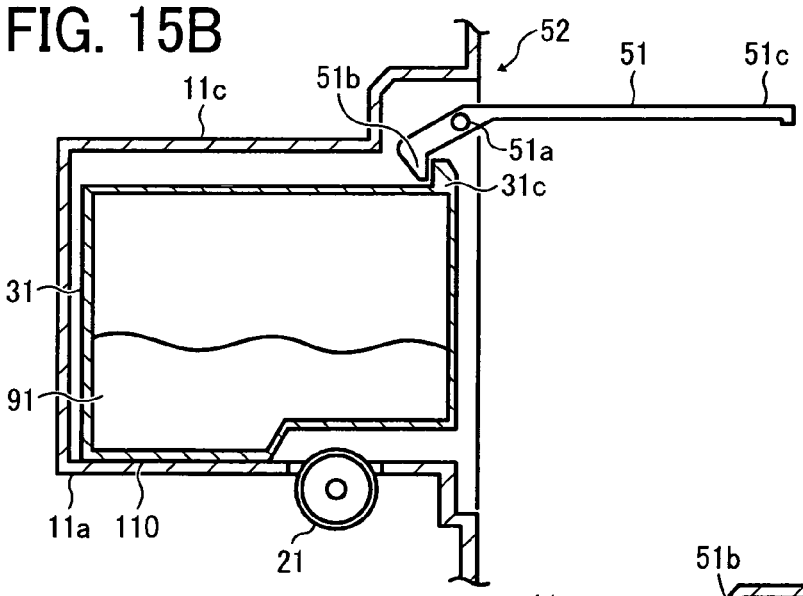
Figure 15C:
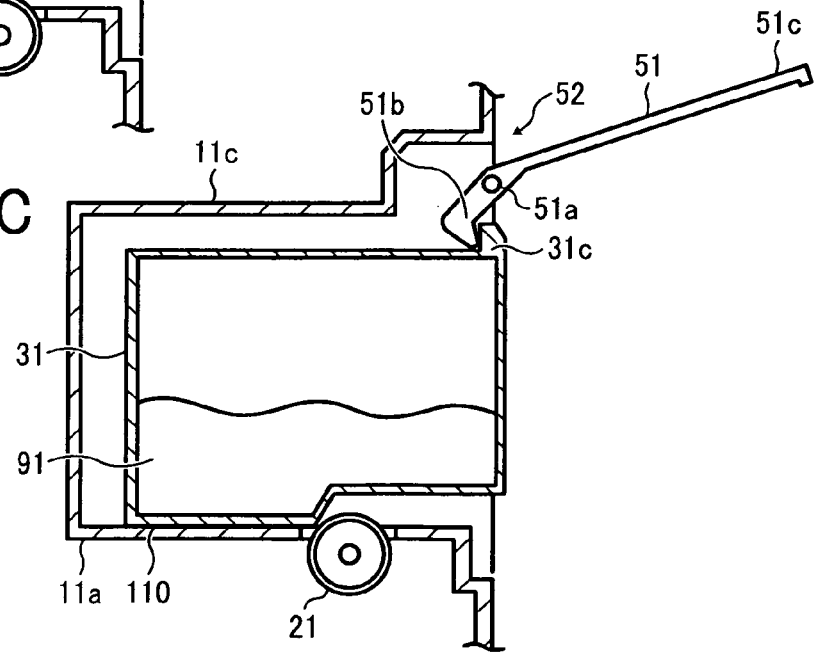

FIGS. 15A to 15C show another example configuration of the door 51 provided for the accommodation unit 18 for the above described example embodiments. As shown in FIGS. 15A to 15C, the withdrawing member 51*b* is disposed at a top end portion of the cover 51*c* of the door 51 while setting an angle between the withdrawing member 51*b* and the cover 51*c* at greater than 90 degrees. Accordingly, in a case of FIG. 15, the withdrawing member 51*b* of the door 51 and the concaved portion 31*c* of the waste toner container 31 can start to engage each other for the first time when the door 51 is opened to an angle greater than an angle when the door 51 is opened in FIG. 14.

The withdrawing member 51*b* of the door 51 and the concaved portion 31*c* of the waste toner container 31 start to engage each other at a condition shown in FIG. 15B, and then the door 51 is further opened with a greater angle condition shown in FIG. 15C, by which the waste toner container 31 can be withdrawn from the interior of the apparatus 1 to the exterior of the apparatus 1. As such, the withdrawing member 51*b* of the door 51 and the concaved portion 31*c* of the waste toner container 31 can engage when the door 51 is opened.

Further, when the door 51 is to be further opened with a greater angle, an opening operation of door 51 may be stopped temporarily. In such a case, a button, a lever, or the like may be disposed at a portion of the accommodation unit 18 which may be near the front side of the apparatus 1, and an operator cancel an engagement of the withdrawing member 51*b* of the door 51 and the concaved portion 31*c* of the waste toner container 31 using such button, lever, or the like, and then the door 51 is to be further opened with a greater angle. In such a configuration, after the withdrawing member 51*b* of the door 51 and the concaved portion 31*c* of the waste toner container 31 engage each other, an opening operation of door 51 may be stopped temporarily before the door 51 is to be further opened with a greater angle, by which a movement of the waste toner container 31 toward the exterior of the apparatus 1, which does not match to an intended movement of an operator, can be prevented.

In the above described example embodiments, even if vibration or the like may occur to an apparatus when a waste toner container is mounted in an apparatus, a jumping-out or bouncing-out of the waste toner container to the exterior of the apparatus can be prevented, and a withdrawing force required for withdrawing the waste toner container to the exterior of the apparatus can be reduced.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus using electrophotography, comprising:

a waste toner container to collect developer used for forming images and ejected from an image forming unit of the image forming apparatus as waste toner; and an accommodation unit to detachably accommodate the waste toner container in the image forming apparatus, wherein the accommodation unit including a reduction device to reduce a force required for withdrawing the waste toner container from an interior to an exterior of the image forming apparatus, the reduction device contacts a bottom face of the waste toner container when the waste toner container is partially withdrawn from a fully mounted position of the waste toner container in the accommodation unit to the exterior of the image forming apparatus, the waste toner container includes a recessed portion formed in the bottom face of the waste toner container, the recessed portion having a height that is higher than a non-recessed portion of the bottom face of the waste toner container, and the reduction device faces the recessed portion while not contacting the bottom face of the waste toner container when the waste toner container is fully mounted in image forming the apparatus.

2. The image forming apparatus of claim 1, wherein the reduction device contacting the non-recessed portion of the bottom face of the waste toner container when the waste toner container is partially withdrawn from the apparatus from the fully mounted position of the waste toner container in the accommodation unit to the exterior of the image forming apparatus.

3. The image forming apparatus of claim 1, further comprising an inclined portion that extends from the bottom face of the waste toner container to a face of the recessed portion.

4. The image forming apparatus of claim 3, wherein the reduction device contacts the inclined portion during withdrawal of the waste toner container from the accommodation unit.

5. The image forming apparatus of claim 1, the accommodation unit further comprising:

a swing plate disposed at a position facing the bottom face of the waste toner container and corresponding to a position of the reduction device; and a biasing member to bias the swing plate toward the waste toner container, the biasing member biasing the swing plate upward, wherein, when a given amount of waste toner accumulates in the waste toner container, the swing plate displaces downward due to a weight of the waste toner container, positioning the reduction device higher than the swing plate and projecting a portion of the reduction device over the swing plate, in which when the waste toner container is partially withdrawn to the exterior of the image forming apparatus, the reduction device contacts the waste toner container to reduce the force required for withdrawing the waste toner container from the interior of the apparatus to the exterior of the apparatus, and wherein the reduction device increases a force required to insert the waste toner container accumulating a given amount of waste toner when the waste toner container is inserted into the interior of the apparatus from the exterior of the image forming apparatus.

6. The image forming apparatus of claim 5, wherein the reduction device includes a roller having a one-way clutch that allows rotation of the roller in a direction in which the waste toner container is withdrawn from the interior of the image forming apparatus to the exterior of the apparatus, and the one-way clutch does not allow rotation of the roller in a direction in which the waste toner container is inserted into the interior of the image forming apparatus from the exterior of the image forming apparatus.

7. The image forming apparatus of claim 5, wherein the reduction device includes a rotatable member that is able to contact the bottom face of the waste toner container and a driving force transmission device to transmit a driving force of a drive source of the image forming apparatus to the rotatable member, and wherein the waste toner container includes a meshing portion at a bottom face of the waste toner container that meshes with the rotatable member.

8. The image forming apparatus of claim 7, wherein the rotatable member is a gear and the meshing portion is a rack that meshes with the gear.

9. The image forming apparatus of claim 8, wherein the gear is formed with a wheel member integrally by forming the wheel member at each end of the gear, the wheel member has a diameter greater than an addendum circle of the gear, and the wheel member has no teeth at an outer face of the wheel member.

10. The image forming apparatus of claim 8, wherein the driving force transmission device includes a torque limiter that absorbs the driving force when the gear receives a predetermined resistance.

11. The image forming apparatus of claim 7, wherein the rotatable member is a worm wheel and the meshing portion is a worm that meshes with the worm wheel.

12. The image forming apparatus of claim 7, wherein the waste toner container includes a meshing face at the bottom face of the waste toner container and a support face projecting from the meshing face, the support face used to support the waste toner container, such that, when the waste toner container stands on a stand face exterior of the apparatus, the support face contacts the stand face.

13. The image forming apparatus of claim 1, wherein the accommodation unit is provided with a door, disposed at a front side of the image forming apparatus, wherein the door includes an assist unit to assist withdrawal of the waste toner container from the interior of the image forming apparatus to the exterior of the image forming apparatus.

14. The image forming apparatus of claim 13, wherein the door includes a door rotation shaft about which the door rotates, wherein the waste toner container includes a convex portion at the front side of the apparatus and the door includes a withdrawing member used as the assist unit to engage with the convex portion to withdraw the waste toner container, the convex portion of the waste toner container and the withdrawing member of the door engaging each other to withdraw the waste toner container toward the front side of the image forming apparatus when the door is opened.

15. The image forming apparatus of claim 1, further comprising a waste toner transporting unit to transport the waste toner ejected from the image forming unit to the waste toner container, and the waste toner transporting unit defines a waste toner transport route disposed between the image forming unit and the accommodation unit, wherein the accommodation unit includes a connection unit connectable to a supply port of the waste toner container to connect the waste toner transport route and the waste toner container, and a flexible tube to connect the connection unit and a downstream end of a waste toner transport direction of the waste toner transport route.

16. The image forming apparatus of claim 15, wherein the connection unit provided for the accommodation unit is movable in an up or down direction by a slider disposed for the image forming apparatus, the accommodation unit changes an arrangement height of the waste toner container in response to an increase in amount of waste toner in the waste toner container, and the connection unit changes a height of the connection unit using the slider in response to a change in arrangement height of the waste toner container.

17. The image forming apparatus of claim 1, wherein the accommodation unit includes a frame and a connection unit extends through the frame and the waste toner container includes a port, and wherein the connection unit extends into an interior space in the waste toner container via the port.

18. An image forming apparatus using electrophotography, comprising:

a waste toner container to collect developer used for forming images and ejected from an image forming unit of the image forming apparatus as waste toner;

an accommodation unit to detachably accommodate the waste toner container in the image forming apparatus; wherein the accommodation unit includes a reduction device to reduce a force required for withdrawing the waste toner container from an interior to an exterior of the image forming apparatus, the reduction device contacts a bottom face of the waste toner container when the waste toner container is partially withdrawn from a fully mounted position of the waste toner container in the accommodation unit to the exterior of the image forming apparatus, the waste toner container includes a recessed portion formed in the bottom face of the waste toner container, the recessed portion having a height that is higher than a non-recessed portion of the bottom face of the waste toner container, the reduction device faces the recessed portion while not contacting the bottom face of the waste toner container when the waste toner container is fully mounted in image forming the apparatus, the reduction device contacting the non-recessed portion of the bottom face of the waste toner container when the waste toner container is partially withdrawn from the apparatus from the fully mounted position of the waste toner container in the accommodation unit to the exterior of the image forming apparatus, and an inclined portion that extends from the bottom face of the waste toner container to a face of the recessed portion.

* * * * *